US011439921B2

(12) United States Patent
McVeen et al.

(10) Patent No.: US 11,439,921 B2
(45) Date of Patent: Sep. 13, 2022

(54) MULTI-DIMENSIONAL BOGIE AND TRACK SYSTEM

(71) Applicant: Universal City Studios LLC, Universal City, CA (US)

(72) Inventors: Keith Michael McVeen, Winter Garden, FL (US); Eric Rae Parr, Orlando, FL (US)

(73) Assignee: Universal City Studios LLC, Universal City, CA (US)

( * ) Notice: Subject to any disclaimer, the term of this patent is extended or adjusted under 35 U.S.C. 154(b) by 841 days.

(21) Appl. No.: 16/241,806

(22) Filed: Jan. 7, 2019

(65) Prior Publication Data

US 2019/0388793 A1 Dec. 26, 2019

Related U.S. Application Data

(60) Provisional application No. 62/689,588, filed on Jun. 25, 2018.

(51) Int. Cl.

| | |
|---|---|
| ***A63G 7/00*** | (2006.01) |
| ***B61B 13/00*** | (2006.01) |
| ***B61B 15/00*** | (2006.01) |
| ***E01B 23/06*** | (2006.01) |
| ***B61J 1/08*** | (2006.01) |
| *A63G 31/16* | (2006.01) |

(52) U.S. Cl.

CPC ..... *A63G 7/00* (2013.01); *B61B 13/00* (2013.01); *B61B 15/00* (2013.01); *B61J 1/08* (2013.01); *E01B 23/06* (2013.01); *A63G 31/16* (2013.01)

(58) Field of Classification Search

CPC ..... A63G 7/00; A63G 31/02; A63G 31/16; B61B 1/04; B61B 1/10; B61B 13/00; B61B 15/00; E01B 23/06; B61J 1/08

USPC ..... 104/48, 53, 63

See application file for complete search history.

(56) References Cited

U.S. PATENT DOCUMENTS

| | | | | |
|---|---|---|---|---|
| 5,440,996 | A | 8/1995 | Cottino | |
| 5,615,992 | A | 4/1997 | Proske et al. | |
| 5,893,802 | A | 4/1999 | Bohme | |
| 6,095,926 | A * | 8/2000 | Hettema | A63G 31/16 104/85 |
| 6,308,818 | B1 | 10/2001 | Bonora et al. | |
| 6,341,564 | B1 | 1/2002 | Ochi | |
| 6,755,749 | B2 | 6/2004 | Stengel | |
| 7,371,182 | B2 | 5/2008 | Henry et al. | |

(Continued)

FOREIGN PATENT DOCUMENTS

| | | |
|---|---|---|
| DE | 102009032406 | 1/2011 |
| KR | 20080083983 A | 9/2008 |
| WO | 2012113679 | 8/2012 |

OTHER PUBLICATIONS

PCT/US2019/035865 Invitation to Pay Additional Fees dated Sep. 20, 2019.

(Continued)

*Primary Examiner* — Zachary L Kuhfuss

(74) *Attorney, Agent, or Firm* — Fletcher Yoder, P.C.

(57) ABSTRACT

A system includes a plurality of rotatable track members that guide travel of a vehicle. Each rotatable track member of the plurality of rotatable track members is configured to individually rotate between a first orientation along a first direction of vehicle travel and a second orientation along a second direction of vehicle travel.

20 Claims, 17 Drawing Sheets

(56) References Cited

U.S. PATENT DOCUMENTS

| | | | | |
|---|---|---|---|---|
| 7,997,540 | B2 * | 8/2011 | Vance | E01B 25/06 246/415 R |
| 8,057,317 | B2 | 11/2011 | Roodenburg et al. | |
| 9,014,965 | B2 * | 4/2015 | King | B61L 15/0018 701/408 |
| 9,486,135 | B1 | 11/2016 | Fram | |
| 10,053,138 | B2 * | 8/2018 | Foster | A63G 31/08 |
| 10,807,010 | B2 * | 10/2020 | Hall | A63G 7/00 |
| 10,814,236 | B1 * | 10/2020 | Dagley | A63G 7/00 |
| 11,065,553 | B2 * | 7/2021 | Blum | A63G 7/00 |
| 2003/0075070 | A1 * | 4/2003 | Spielberg | E01B 23/06 104/130.01 |
| 2007/0074638 | A1 | 4/2007 | Blum et al. | |
| 2010/0056020 | A1 | 3/2010 | Parker et al. | |
| 2010/0243406 | A1 | 9/2010 | Mersnik | |
| 2012/0026467 | A1 * | 2/2012 | Chapman | F16M 11/18 352/243 |
| 2014/0165868 | A1 | 6/2014 | Comorre | |
| 2014/0174314 | A1 * | 6/2014 | Schmidt | A63G 7/00 104/53 |
| 2016/0023121 | A1 * | 1/2016 | McVeen | A63G 7/00 104/84 |
| 2019/0161099 | A1 * | 5/2019 | Burger | A63G 7/00 |

OTHER PUBLICATIONS

Jagolinzer, Scott, "Tackless Multi-Dimensional Ride Vehicle," May 13, 2015, https://contest.techbriefs.com/2015/entries/automotive-transportation/5347.

CN 201980042474.3 Office Action dated Dec. 28, 2021.

* cited by examiner

MULTI-DIMENSIONAL BOGIE AND TRACK SYSTEM

CROSS-REFERENCE TO RELATED APPLICATION

This application claims priority to and the benefit of U.S. Provisional Application No. 62/689,588, entitled "Multi-Dimensional Bogie and Track System," filed Jun. 25, 2018, which is hereby incorporated by reference in its entirety for all purposes.

BACKGROUND

The present disclosure relates generally to amusement park-style rides, and more specifically to systems for controlling motion of a ride vehicle of the amusement park-style rides.

Generally, amusement park-style rides include ride vehicles that carry passengers along a ride path, for example, defined by a track. Over the course of the ride, the ride path may include a number of features, including tunnels, turns, ascents, descents, loops, and so forth. The direction of travel of the ride vehicle may be defined by the ride path, as rollers of the ride vehicle may be in constant contact with the tracks defining the ride path. In this manner, executing turns may require a ride vehicle to traverse along the ride path in a motion having a substantially large turning radius, often to control the centripetal acceleration associated with performing such conventional turns. Further, ride passengers may anticipate these conventional turns, reducing excitement and thrill associated with amusement park-style rides. Accordingly, it may be desirable to perform unconventional turns, such as turns with little to no turning radii, in certain motion-based amusement park-style rides, for example, to enhance the excitement and thrill of the ride experience, the implementation of which may be difficult to coordinate in practice.

BRIEF DESCRIPTION

Certain embodiments commensurate in scope with the originally claimed subject matter are summarized below. These embodiments are not intended to limit the scope of the claimed subject matter, but rather these embodiments are intended only to provide a brief summary of possible forms of the subject matter. Indeed, the subject matter may encompass a variety of forms that may be similar to or different from the embodiments set forth below.

In an embodiment, a system includes a plurality of rotatable track members configured to guide travel of a vehicle, wherein each rotatable track member of the plurality of rotatable track members is configured to individually rotate between a first orientation along a first direction of vehicle travel and a second orientation along a second direction of vehicle travel.

In another embodiment, a method for controlling multi-dimensional motion of a vehicle includes decelerating, via a controller, the vehicle traveling in a first direction along a path to stop the vehicle at a first position along the path, wherein the path comprises a plurality of rotatable track members, and wherein each rotatable track member of the plurality of rotatable track members is coupled to a drive system. The method also includes confirming, via the controller, that the vehicle is stopped on the plurality of rotatable track members at the first position along the path, wherein a respective first rotation axis of each rotatable track member of the plurality of rotatable track members is substantially aligned with a respective second rotation axis of a corresponding roller assembly of a plurality of roller assemblies of the vehicle when the vehicle is stopped at the first position along the path. The method further includes rotating, via the controller, the plurality of rotatable track members from a first orientation along the first direction to a second orientation along a second direction different from the first direction.

In yet another embodiment, a ride system includes rotatable track members that define a first portion of a first ride path when oriented in a first direction and define a second portion of a second ride path when oriented in a second direction. The ride system also includes a ride vehicle that includes one or more roller assemblies that facilitate ride vehicle motion along the first ride path and the second ride path. The ride system also includes a controller communicatively coupled to the ride vehicle and the rotatable track members. The controller controls the motion of the ride vehicle and rotation of the rotatable track members. Furthermore, the controller includes a processor and a memory device having instructions stored thereon and to be executed by the processor. The instructions cause the processor to instruct the ride vehicle to decelerate while the ride vehicle is traveling along the first ride path in the first direction to a stopped position on the rotatable track members, such that each roller assembly of the one or more roller assemblies shares an axis of rotation with a corresponding rotatable track member of in the stopped position. The instructions also cause the processor to send a signal to a driving system to selectively rotate the rotatable track members from a first orientation along the first direction to a second orientation along the second direction, such that selectively rotating the rotatable track members causes rotation of each roller assembly about the respective axis of rotation.

DRAWINGS

These and other features, aspects, and advantages of the present disclosure will become better understood when the following detailed description is read with reference to the accompanying drawings in which like characters represent like parts throughout the drawings, wherein.

Figure 16:
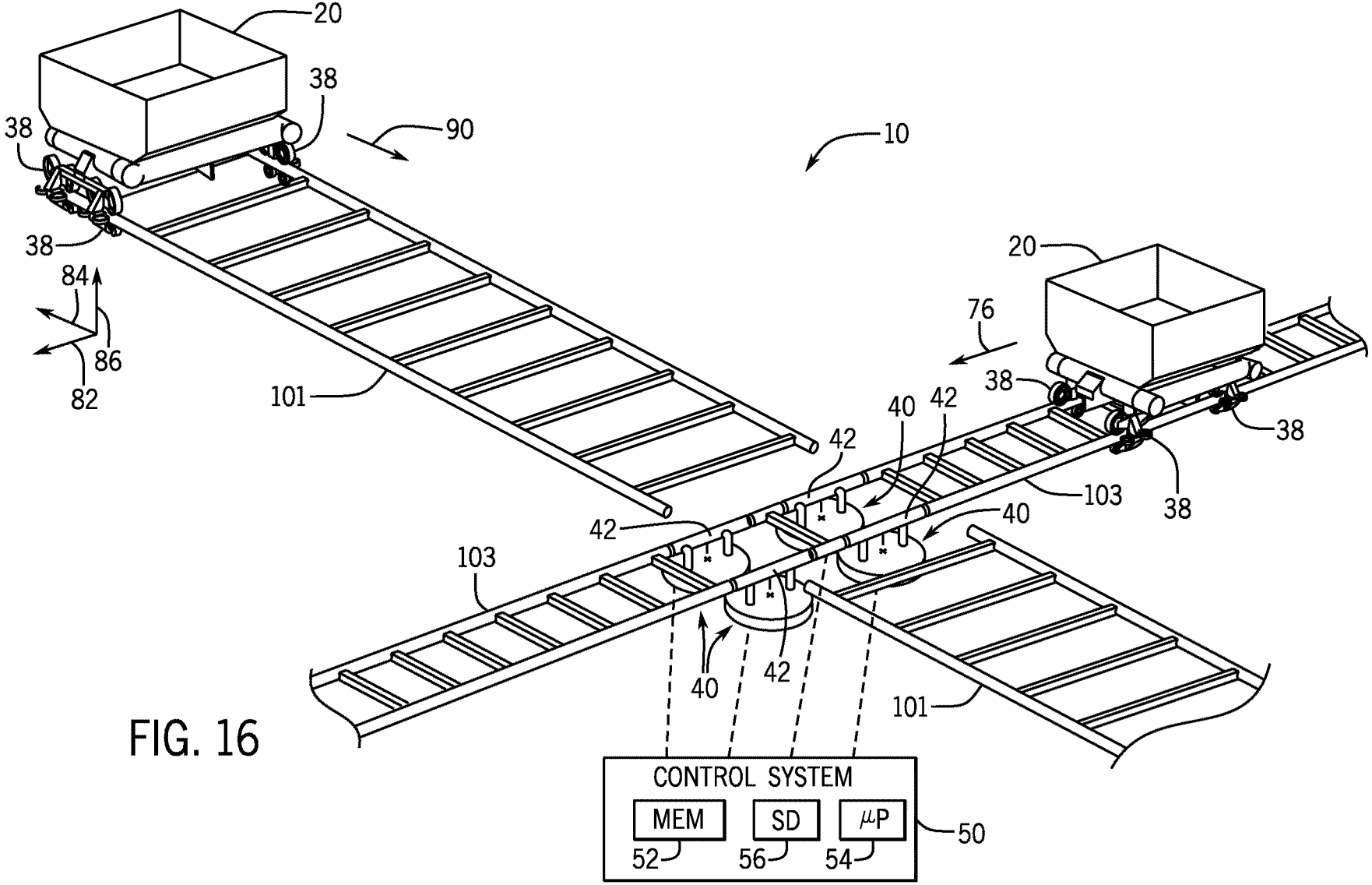
Figure 17:
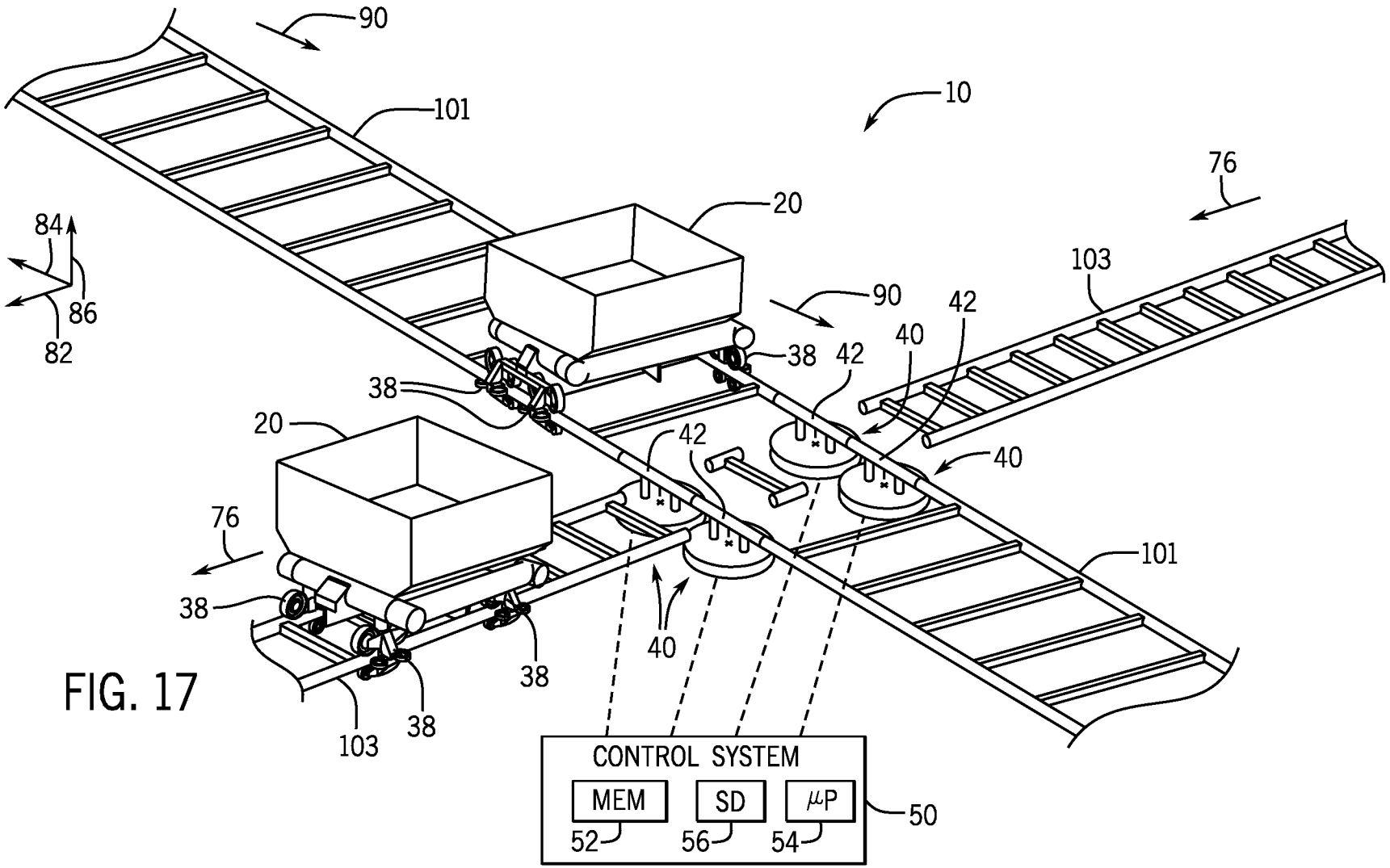

FIG. 16 is a schematic diagram of an embodiment of ride vehicles operating on respective ride paths, such that the motion of the ride vehicles is facilitated via a rotating motion system, in accordance with aspects of the present disclosure; and FIG. 17 is a schematic diagram of another embodiment of ride vehicles operating on respective ride paths, such that the motion of the ride vehicles is facilitated via a rotating motion system, in accordance with aspects of the present disclosure.

DETAILED DESCRIPTION

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

While the following discussion is generally provided in the context of amusement park-style rides, it should be understood that the embodiments disclosed herein are not limited to such entertainment contexts. Indeed, the systems, methods, and concepts disclosed herein may be implemented in a wide variety of applications. The provision of examples in the present disclosure is to facilitate explanation of the disclosed techniques by providing instances of real-world implementations and applications. It should be appreciated that the embodiments disclosed herein may be useful in many applications, such as transportation systems (e.g., train systems), conveyer line systems, distribution systems, logistics systems, automation dynamic systems, and/or other industrial, commercial, and/or recreational systems, to name a few.

For example, amusement park-style rides may employ ride vehicles that carry passengers along a ride path, for example, defined by a track. Over the course of the ride, the ride path may include a number of features, including tunnels, turns, ascents, descents, loops, and so forth. The direction of travel of the ride vehicle may be defined by the ride path, as rollers of the ride vehicle may be in constant contact with the tracks defining the ride path. In this manner, performing turns may involve a ride vehicle traversing along the ride path in a motion having a substantially large turning radius to control the centripetal acceleration associated with performing such turns. Further, ride passengers may anticipate these turns, reducing or eliminating excitement and thrill typically associated with amusement park-style rides. Accordingly, it may be desirable to perform unconventional turns, such as turns with little to no turning radii, in certain motion-based amusement park-style rides, for example, to enhance the excitement and thrill of the ride experience. However, enabling the ride vehicle to execute certain unconventional turns, such as 90 degree turns (e.g., turns with a small turning radius or no turning radius), while traveling along the ride path may be difficult to implement in practice.

Typically, motion bases or platforms, separate from the tracks of the ride path and external to the ride vehicle, may enable this 90 degree motion, but these motion bases include certain drawbacks. For example, these motion bases typically receive the ride vehicle before a 90 degree motion is possible. That is, the ride vehicle may exit the ride path before entering and engaging with a motion base separate from the ride path. The motion base may be visible to the ride passengers, causing the ride passengers to again anticipate a turn, reducing the excitement and thrill typically associated with the ride experience. To the extent that these motion bases may be hidden from passengers, the motion base may typically enable simple rotation about a plane (e.g., a plane spanned by the motion base). For example, the motion base may merely be able to rotate about a plane substantially orthogonal to the gravity vector, as motion in this direction does not involve substantial action against gravity, which may be easier than otherwise generating motion acting against gravity. In short, existing techniques for enabling certain types of motion may include numerous limitations.

With the foregoing in mind, by using the systems and methods disclosed herein, the ride experience may be enhanced. In an embodiment, a system includes rotatable track members that may receive a roller assembly of the ride vehicle. The rotatable track members may individually rotate between a first orientation and a second orientation to control and adjust a direction of travel of the ride vehicle. Rotation from the first orientation to the second orientation may cause the track members to change from being aligned with a first set of tracks to being aligned with a second set of tracks, with each set of tracks oriented in different directions. That is, the rotatable track members may define the direction of travel for the ride vehicle as in a first orientation along a first set of tracks or as in a second orientation along a second set of tracks. In an embodiment, the track members and the roller assembly may rotate together about a common axis of rotation as the rotatable track members are rotated (individually or as a set) from the first orientation to the second orientation. By employing the embodiments disclosed herein, the system may be able to seamlessly change the direction of travel of a ride vehicle from a lateral direction to a longitudinal direction, from a lateral direction to a vertical direction, or from a vertical direction to the longitudinal direction, to name a few, by actuating rotatable track members in accordance with control instructions.

Figure 1:
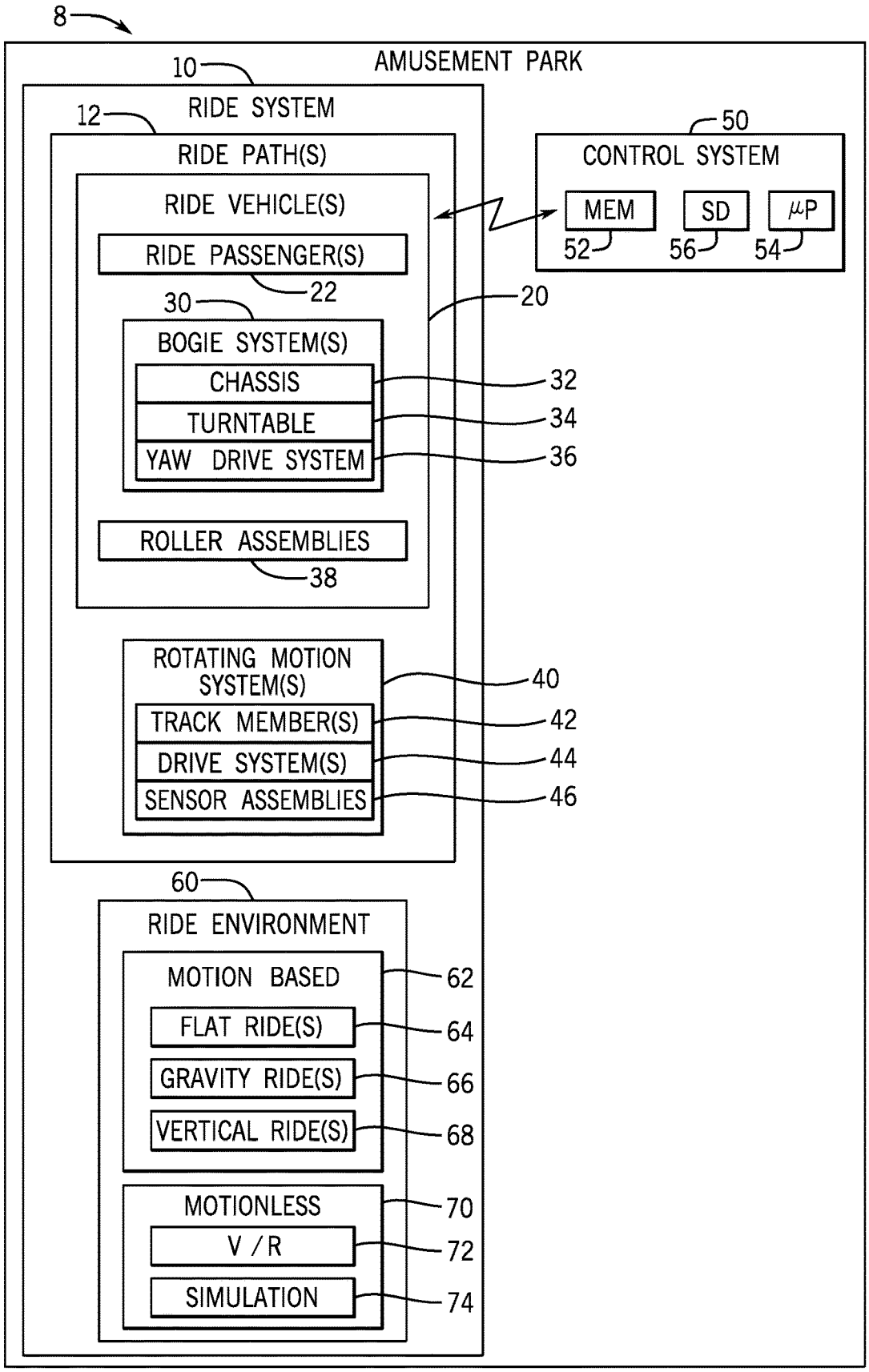
FIG. 1 is a block diagram of an embodiment of various components of an amusement park, in accordance with aspects of the present disclosure.

To help illustrate, FIG. 1 is a block diagram of an embodiment of various components of an amusement park 8, in accordance with aspects of the present disclosure. The amusement park 8 may include a ride system 10, which includes a ride path 12 that receives and guides a ride vehicle 20, such as by engaging with tires or rollers of the ride vehicle 20, and facilitates movement of the ride vehicle 20 along the ride path 12. In this manner, the ride path 12 may define a trajectory and direction of travel that may include turns, inclines, declines, ascents, descents, banks, loops, and the like. In an embodiment, the ride vehicle 20 may be passively driven or actively driven via a pneumatic system, a motor system, a tire drive system, fins coupled to an electromagnetic drive system, a catapult system, and the like.

The ride path 12 may receive more than one ride vehicle 20. The ride vehicles 20 may be separate from one another, such that they are independently controlled, or the ride vehicles 20 may be coupled to one another via any suitable linkage, such that motion of the ride vehicles 20 is coupled or linked. For example, the front of one ride vehicle 20 may be coupled to a rear end of another ride vehicle 20 via a pin system. Each ride vehicle 20 in these and other configurations may hold one or more ride passengers 22.

The ride vehicle 20 may include a bogie system 30 having a chassis 32, a turntable 34, a yaw drive system 36, and a roller assembly 38. While the embodiments disclosed herein are discussed as including passively driven rollers or drive mechanisms, it should be understood that other motion enabling features, such as actively driven or passively driven tires, tracks, or actuatable components, may be employed. The bogie system 30 may include a suspension system, which may dampen motion or vibrations while the ride vehicle 20 is in operation, for example, by absorbing vibration and reducing centrifugal forces when the ride vehicle 20 executes certain motions, such as turns, at certain velocities. The suspension system may be actuated to enhance the ride experience for ride passengers 22, for example, by stiffening, vibrating, or rotating components of the suspension system.

The chassis 32 may support a motor, a pneumatic driving system, an electrical system, a cab that houses the ride passengers 22, and the like. The chassis 32 may be configured to support the load of the various components of the ride vehicle 20 and the ride passengers 22. Furthermore, the turntable 34 may be positioned between the chassis 32 and the cab that the ride passengers 22 are secured within. In an embodiment, the turntable 34 may be rigidly coupled to the cab, such that rotation of the turntable, in response to control instructions, results in a similar rotation of the cab relative to the chassis 32 to further enhance the ride experience.

The yaw drive system 36 may be positioned between the chassis 32 and the cab. In an embodiment, the yaw drive system 36 may be integral to the turntable 34. The yaw drive system 36 may receive control instructions to actuate the turntable 34 in accordance with the control instructions. For example, the yaw drive system 36 may cause the turntable 34 to rotate the cab relative to the chassis 32. Furthermore, the yaw drive system 36 may enable the cab to move relative to the chassis 32 in any suitable direction. To this end, the yaw drive system 36 may enable the cab to rotate about or vibrate along a yaw axis, a pitch axis, or a roll axis, as discussed in detail below. In this manner, the yaw drive system 36 may enable six degrees-of-freedom motion of the cab relative to the chassis 32. In an embodiment, the ride vehicle 20 may include an orientation sensor, such as a gyroscope and/or accelerometer, configured to provide feedback for use in determining motion of the cab, such as linear motion along three orthogonal axes, and the roll, pitch, and yaw of the cab.

The ride vehicle 20 may include the roller assembly 38, which may include one or more rollers that engage with the tracks defining the ride path 12. For example, the roller assembly 38 may include running rollers or actively driven rollers to drive and/or guide motion of the ride vehicle 20 along the ride path 12, up-stop rollers that couple to the underside of the tracks, side friction rollers that couple to the side of the tracks, or any combination thereof. Additionally, the roller assembly 38 may be rotatably coupled to the chassis 32, such that the roller assembly 38 may rotate relative to the chassis 32, as described in detail below. Rotation of the roller assembly 38 relative to the chassis 32 may enable the ride vehicle 20 to change a direction of travel of the ride vehicle 20, as described in detail below.

The ride path 12 may include a rotating motion system 40, as described in detail below. The rotating motion system 40 may include rotatable track members 42, which may be individually driven by one or more drive systems 44. Alternatively, the drive system 44 may drive motion of the rotatable track members 42 as one or more sets of rotatable track members 42. The rotatable track members 42 may be positioned along the ride path 12 and may include dimensions (e.g., cross sectional area) substantially similar to the tracks of the ride path 12, such that the ride vehicle 20 may seamlessly transition from the tracks of the ride path 12 to the rotatable track members 42. In other words, the rotatable track members 42 may be components of the ride system 10 that at least partially define the ride path 12. To this end, tires or rollers, which may be coupled to the chassis 32, may roll or translate along the ride path 12 defined by the tracks, and thereby direct the motion of the ride vehicle 20 toward the rotatable track members 42.

The rotatable track members 42 may include a stopping device, such as a dead end stopping pin or any suitable device configured to decelerate the ride vehicle 20 to enable the ride vehicle 20 to stop at a target position on one or more of the rotatable track members 42. For example, the stopping device may be configured to limit rotation of the rollers or tires of the ride vehicle 20 relative to the rotatable track member 42 after the rollers or tires come into contact with the stopping device, thereby rendering the ride vehicle 20 stationary relative to the rotatable track members 42. In an embodiment, the stopping device may include one or more sensor assemblies 46 configured to provide feedback indicative of the position of the rollers or tires and of the ride vehicle 20. In this manner, the sensor assemblies 46 may be used to confirm that the ride vehicle 20 is stationary in a desired or target position on or relative to one or more of the rotatable track members 42.

The sensor assemblies 46 may be communicatively coupled to a control system, as discussed in detail below. For example, the sensor assembly 46 may include a pressure sensor positioned on one or more of the rotatable track members 42 to determine a pressure at a certain position (e.g., along the axis of rotation) on the rotatable track member 42, such that when a threshold pressure value at a certain point along the rotatable track member 42 is reached, the rotatable track members 42 may be individually rotated, as described in detail below. The sensor assembly 46 may include infrared sensors positioned along walls of the ride path 12 to determine the position of the ride vehicle 20 along the ride path 12.

The rotatable track members 42 may each be coupled to one or more corresponding drive systems 44. For example, the drive system 44 may include a motor, gear assembly, electromechanical or pneumatic actuator, or any combination thereof, configured to facilitate rotation of the rotatable track member 42 associated with the drive system 44. The drive system 44 may drive one or more of the rotatable track members 42 in rotation to enable a change in the direction of travel of the ride vehicle 20 from being along a first portion of the ride path 12 to being along a second portion (e.g., perpendicular to the first portion) of the ride path 12. In this manner, the drive system 44 may individually drive the one or more rotatable track members 42 in rotation to change the direction of travel of the ride vehicle 20 from a first direction of travel to a second direction of travel, in an embodiment, without adjusting an orientation of the ride vehicle 20 relative to an environment surrounding the ride system 10.

The amusement park 8 may include a control system 50 that is communicatively coupled (e.g., via wired or wireless features) to the ride vehicle 20 and the features on the ride path 12. In an embodiment, the amusement park 8 may include more than one control system 50. For example, the amusement park 8 may include one control system 50 associated with the ride vehicle 20, another control system 50 associated with the rotating motion system 40, a base station control system 50, and the like, such that each of the control systems 50 is communicatively coupled to other control systems 50 (e.g., via respective transceiver or wired connections).

The control system 50 may be communicatively coupled to one or more ride vehicle(s) 20 of the amusement park 8 via any suitable wired and/or wireless connection (e.g., via transceivers). The control system 50 may control various aspects of the ride system 10. For example, in some portions of the ride path 12, the control system 50 may control or adjust the direction of travel of the ride vehicle 20 by actuating the rotating motion system 40 to drive motion of the rotatable track members 42. The control system 50 may receive data from the sensor assemblies 46 to, for example, control rotation of the rotating motion system 40. In an embodiment, the control system 50 may be an electronic controller having electrical circuitry configured to process data associated with the ride vehicle 20, for example, from sensor assemblies 46 via the transceivers. Furthermore, the control system 50 may be coupled to various components of the amusement park 8 (e.g., park attractions, park controllers, and wireless networks).

The control system 50 may include a memory device 52 and a processor 54, such as a microprocessor. The control system 50 may also include one or more storage devices 56 and/or other suitable components. The processor 54 may be used to execute software, such as software for controlling the ride vehicle(s) 20 and any components associated with the ride vehicle 20 (e.g., the rotating motion system 40 and bogie system 30). Moreover, the processor 54 may include multiple microprocessors, one or more "general-purpose" microprocessors, one or more special-purpose microprocessors, and/or one or more application-specific integrated circuits (ASICs), or some combination thereof. For example, the processor 54 may include one or more reduced instruction set (RISC) processors.

The memory device 52 may include a volatile memory, such as random-access memory (RAM), and/or a nonvolatile memory, such as read-only memory (ROM). The memory device 52 may store a variety of information and may be used for various purposes. For example, the memory device 52 may store processor-executable instructions (e.g., firmware or software) for the processor 54 to execute, such as instructions for controlling components of the ride vehicle 20, the rotating motion system 40, and/or the bogie system 30. For example, the instructions may cause the processor 54 to control motion of the turntable 34 and the yaw drive system 36 to subject the passengers 22 to ride-enhancing motions, while also controlling the rotating motion system 40 to change a direction of travel of the ride vehicle 20 to enhance the overall ride experience.

The storage device(s) 56 (e.g., nonvolatile storage) may include ROM, flash memory, a hard drive, or any other suitable optical, magnetic, or solid-state storage medium, or a combination thereof. The storage device(s) 56 may store data (e.g., passenger information, data associated with the amusement park 8, data associated with a ride path trajectory), instructions (e.g., software or firmware for controlling the bogie system 30, the rotating motion system 40, and/or the ride vehicle 20), and any other suitable information.

The ride system 10 may include a ride environment 60, which may include multiple and differing combinations of environments. The ride environment 60 may include the type of ride (e.g., dark ride, water coaster, roller coaster, VR experience, or any combination thereof) and/or associated characteristics (e.g., theming) of the type of ride. For example, the ride environment 60 may include aspects of the ride system 10 that add to the overall theming and/or experience associated with the ride system 10.

The ride system 10 may have a motion-based environment 62, in which the passengers 22 are transported or moved by the ride system 10. For example, the motion-based environment 62 may include a flat ride 64 (e.g., a ride that moves passengers 22 substantially within a plane that is generally aligned with the ground, such as by the turntable 34 rotating about a vertical axis and/or the ride vehicle 20 translating along a substantially flat path), a gravity ride 66 (e.g., a ride where motion of the passengers 22 has at least a component of movement along the gravity vector), and/or a vertical ride 68 (e.g., a ride that displaces passengers 22 in a vertical plane around a fixed point).

The ride system 10 may include a motionless environment 70, in which the passengers 22 are not substantially transported or displaced by the ride system 10. For example, the motionless environment 70 may include a virtual reality (V/R) feature 72 (e.g., the passenger 22 may sit in a seat that vibrates or remains stationary while wearing a virtual reality (V/R) headset displaying a VR environment or experience) and/or a different kind of simulation 74. In an embodiment, the ride vehicle 20 may come to a stop along the ride path 12, such that the ride experience may include aspects of the motionless environment 70 for a portion of the duration of the ride experience. While the passengers 22 may not move substantially in the motionless environment 70, virtual reality and/or simulation effects may cause disorientation of the passengers 22, which may be enhanced and contrasted by motion-based distortion experienced by passengers 22. To that end, it should be understood the ride system 10 may include both motion-based and motionless environments 62 and 70, which make the rotating motion system 40 desirable at least for enhancing the ride experience.

Figure 2:
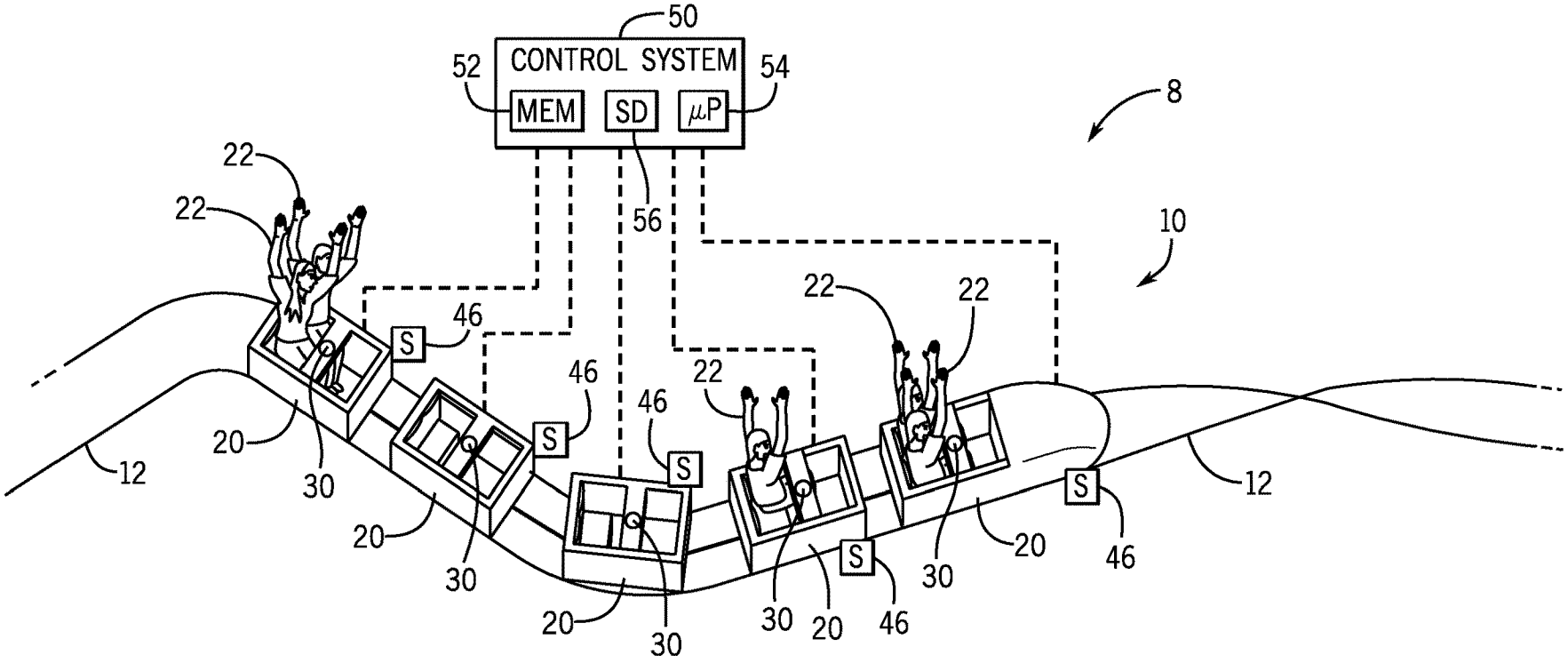
FIG. 2 is a schematic diagram of an embodiment a ride system, in accordance with aspects of the present disclosure.

FIG. 2 is a schematic diagram of an embodiment of the ride system 10, in accordance with aspects of the present disclosure. The ride system 10 may include multiple ride vehicles 20 coupled together via linkages to join passengers 22 riding in corresponding ride vehicles 20 in a common ride experience. In an embodiment, the ride vehicles 20 may not be coupled to one another and may instead move independently of one another, for example, along respective and/or separate ride paths 12. In another embodiment, ride vehicles 20 may move together in groupings or as sets of ride vehicles 20. For example, a first set of ride vehicles 20 (e.g., three ride vehicles) may move along a first path, and a second set of ride vehicles 20 (e.g., five ride vehicles) may move along a second path. It should be understood that the control system 50 may instruct the ride vehicles 20 to travel along the one or more ride paths 12 in any desired manner.

The ride path 12 may include any features that define the direction of travel of the ride vehicle 20. In an embodiment, the ride path 12 may include a track (with rotatable track members 42 (FIG. 1)), a rail, a road, a chute, or any combination thereof. For example, the ride path 12 may control the movement (e.g., direction, speed, and/or orientation) of the ride vehicle 20 as the ride vehicle 20 progresses along the ride path 12, similar to a train on train tracks. The control system 50 may enable the ride vehicle 20 to execute a number of substantially ninety degree turns (e.g., without adjusting an orientation of the ride vehicle 20) having a reduced turning radius, as described in detail below.

Figure 3:
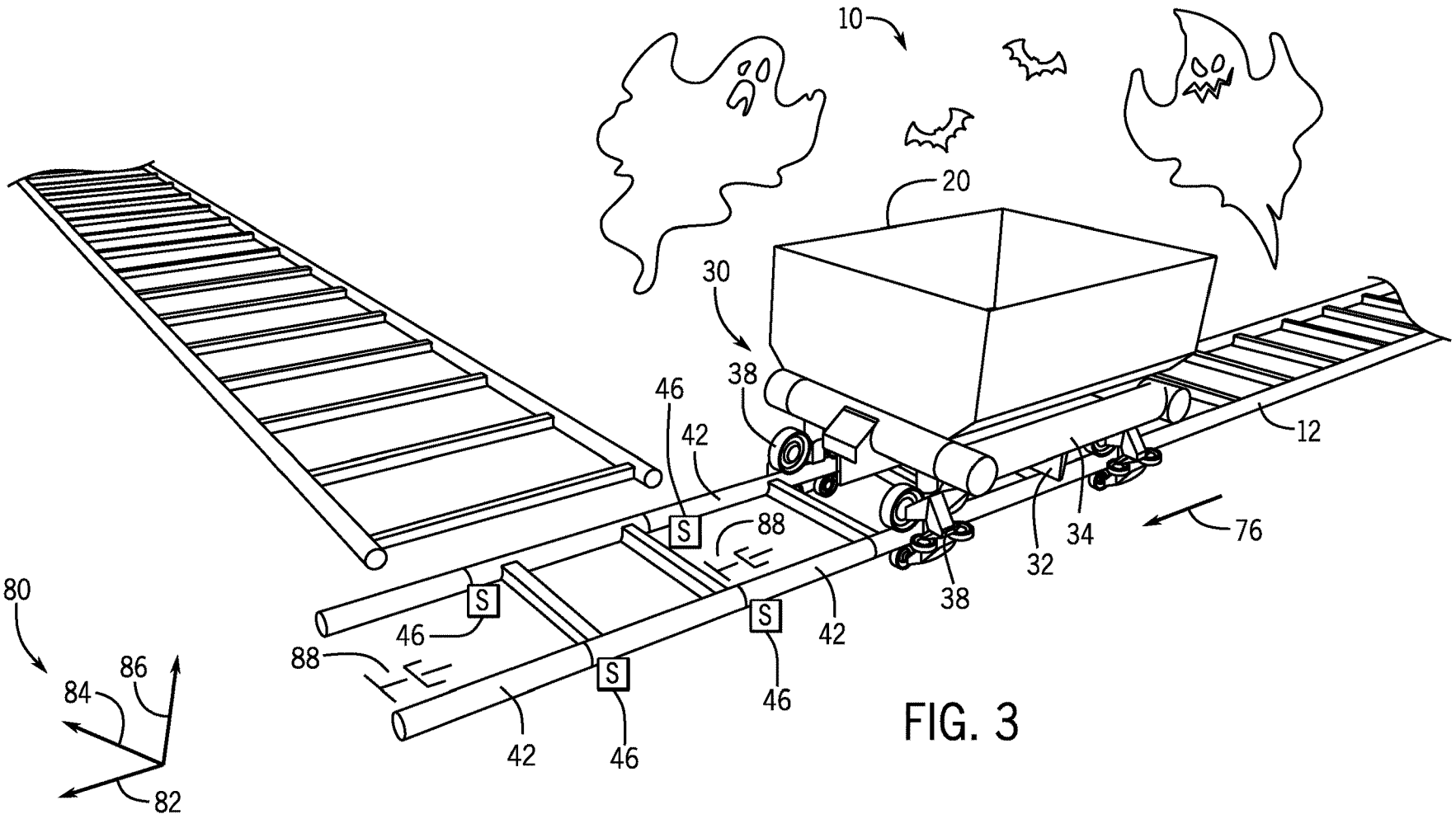
FIG. 3 is a schematic diagram of an embodiment of a ride vehicle operating in a ride system of and traveling along a first direction of travel, in accordance with aspects of the present disclosure.

FIG. 3 is schematic diagram of an embodiment of the ride vehicle 20 operating in the ride system 10 and traveling along a first direction of travel 76, in accordance with aspects of the present disclosure. To facilitate discussion, a coordinate system 80 may include a longitudinal axis 82, a lateral axis 84, and a vertical axis 86, such that the axes of the coordinate system 80 are orthogonal to one another. Furthermore, the first direction of travel 76 is oriented substantially parallel to or along the longitudinal axis 82. The ride vehicle 20 may travel along the ride path 12 in the first direction of travel 76 and stop on the rotatable track members 42, which are aligned with the ride path 12 along the first direction of travel 76. In an embodiment, a stopping device 88 may enable the ride vehicle 20 to stop on the rotatable track members 42 in a desired position. For example, the position at which the stopping device 88 blocks movement of the ride vehicle 20 may be a location in which the rotational axis of the rotatable track member 42 substantially matches or is aligned with the rotational axis of the corresponding roller assemblies 38 of the ride vehicle 20.

Figure 4:
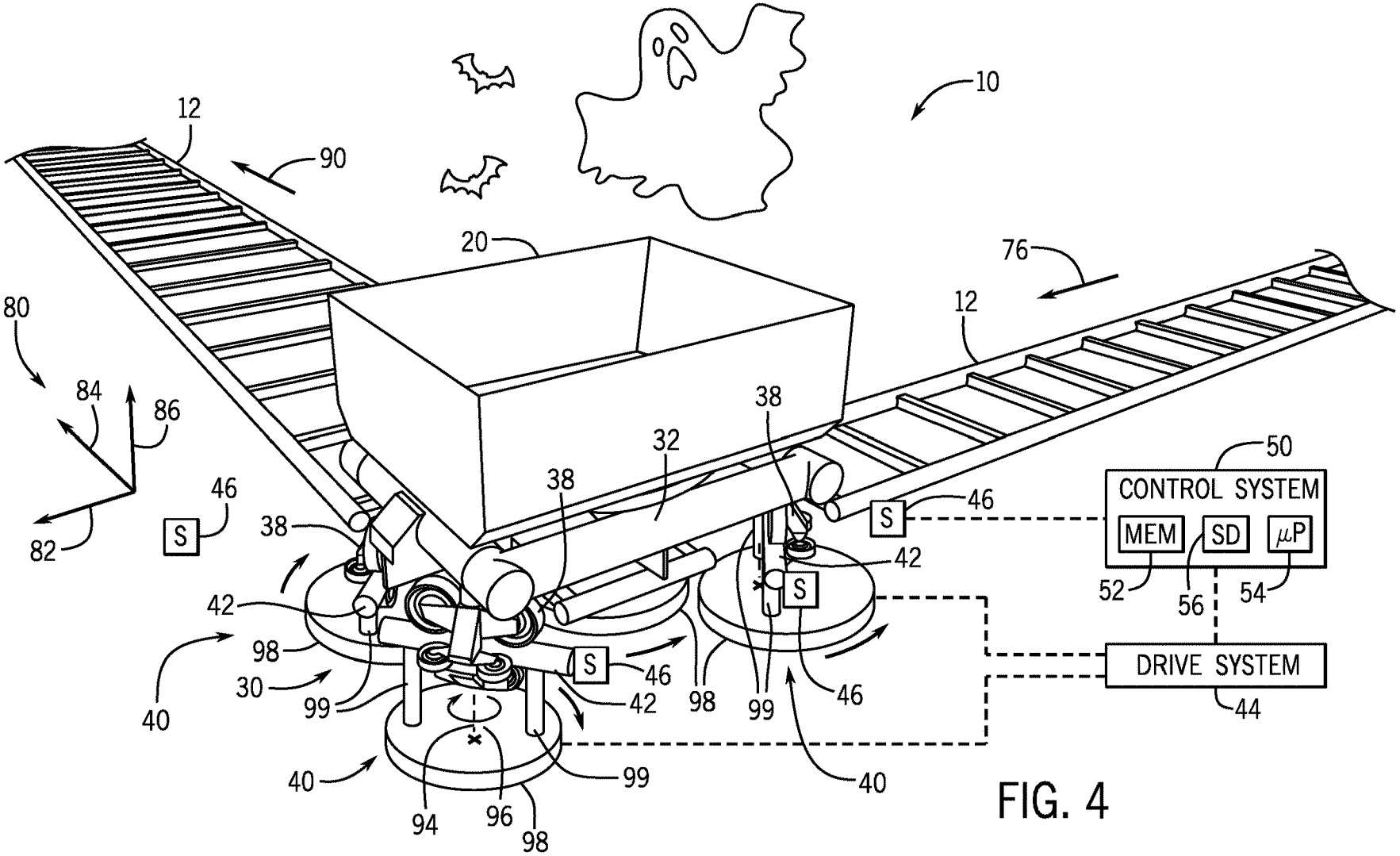
FIG. 4 is a schematic diagram of an embodiment of a rotating motion system actuating to enable a ride vehicle to change a direction of travel of the ride vehicle from a first direction of travel to a second direction of travel, in accordance with aspects of the present disclosure.

FIG. 4 is a schematic diagram of an embodiment of the rotating motion system 40 actuating to enable the ride vehicle 20 to change direction of travel from the first direction of travel 76 to a second direction of travel 90, in accordance with aspects of the present disclosure. The ride vehicle 20 may travel along the ride path 12 in the first direction of travel 76 and stop on the rotatable track members 42, as discussed above with reference to FIG. 3. The bogie system 30 may include one or more roller assemblies 38 arranged to rotate relative to the chassis 32 about one or more rotational axis, as discussed below. For example, the chassis 32 may include four roller assemblies 38 (e.g., under the chassis 32 at each corner of the ride vehicle 20). Each roller assembly 38 may be rotatably coupled to the chassis 32, such that each roller assembly 38 rotates in a respective first direction 94 about a respective first axis 96 substantially parallel to the vertical axis 86. The ride vehicle 20 may stop on the rotatable track member 42 (e.g., via the stopping device 88), such that the axis of rotation for each roller assembly 38 substantially aligns with the axis of rotation of the corresponding rotatable track member 42 positioned beneath the roller assembly 38 when the ride vehicle 20 is stopped.

The control system 50 may instruct the drive system 44 to drive the rotating motion system 40 in rotation about the first axes 96 to change the direction of travel of the ride vehicle 20 from the first direction of travel 76 to the second direction of travel 90. For example, the first direction of travel 76 may be substantially perpendicular to the second direction of travel 90 along a plane of travel spanned by the longitudinal axis 82 and the lateral axis 84. In an embodiment, the rotating motion system 40 may include a plurality of platforms 98 configured to be driven in rotation via the drive system 44, such as based on control instructions from the control system 50. Each of the platforms 98 may be rigidly coupled to one or more of the rotatable track members 42 via one or more bar members 99. While each platform 98 is illustrated as including two bar members 99 coupled to a corresponding rotatable track member 42, it should be understood that any number of bar members 99 or platforms 98 may be employed to facilitate rotation of the rotatable track members 42.

While the rotatable track members 42 discussed herein receive and couple to corresponding roller assemblies 38 to drive the roller assemblies 38 in rotation to modify a direction of travel of the ride vehicle 20, it should be understood that, in an embodiment, the roller assemblies 38 may include actuatable components communicatively coupled to the control system 50. In this manner, the roller assemblies 38 may receive control instructions to individually drive the rotatable track members 42 in rotation to change the direction of travel of the ride vehicle 20 from the first direction of travel 76 to the second direction of travel 90. In other words, the roller assemblies 38 may include components configured to actively drive rotation of the roller assemblies 38, which may correspondingly drive rotation of the rotatable track members 42.

It should be understood that, to facilitate discussion and illustration, features present in the embodiments of FIGS. 3 and 4 have been omitted in the subsequent figures. However, it should be understood that the embodiments of the subsequent figures may include any of the features included in the embodiments of the preceding figures.

Figure 5:
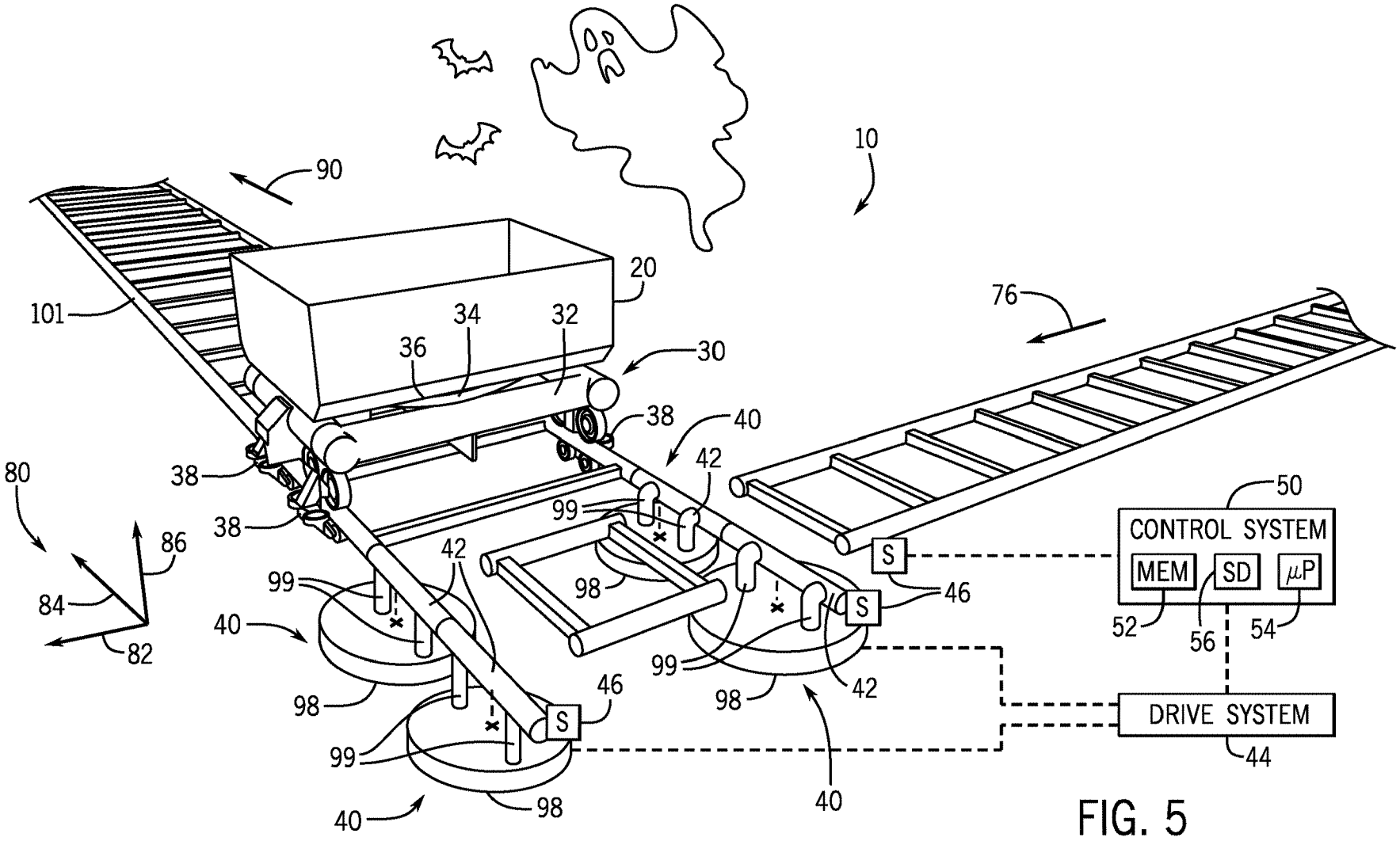
FIG. 5 is a schematic diagram of an embodiment of a ride vehicle operating in a ride system and traveling along a second direction of travel, in accordance with aspects of the present disclosure.

FIG. 5 is a schematic diagram of an embodiment of the ride vehicle 20 operating in the ride system 10 and traveling along the second direction of travel 90, in accordance with aspects of the present disclosure. After the control system 50 instructs the drive system 44 to rotate the rotatable track members 42, the ride system 10 may verify that the position of the rotatable track members 42 is aligned with tracks 101 extending in the second direction of travel 90, and the ride vehicle 20 may be driven along the tracks 101 in the second direction of travel 90. It should be noted that, during the rotation of the rotatable track members 42 and the transition of the ride vehicle 20 from the first direction of travel 76 to the second direction of travel 90, the orientation of the ride vehicle 20 remains unchanged. It should be understood that the control system 50 may actuate the bogie system 30 (e.g., the turntable 34 and/or the yaw drive system 36) before, during, or after changing the direction of travel of the ride vehicle 20 to subject the passengers 22 to additional motion, thereby further enhancing the ride experience.

Figure 6:
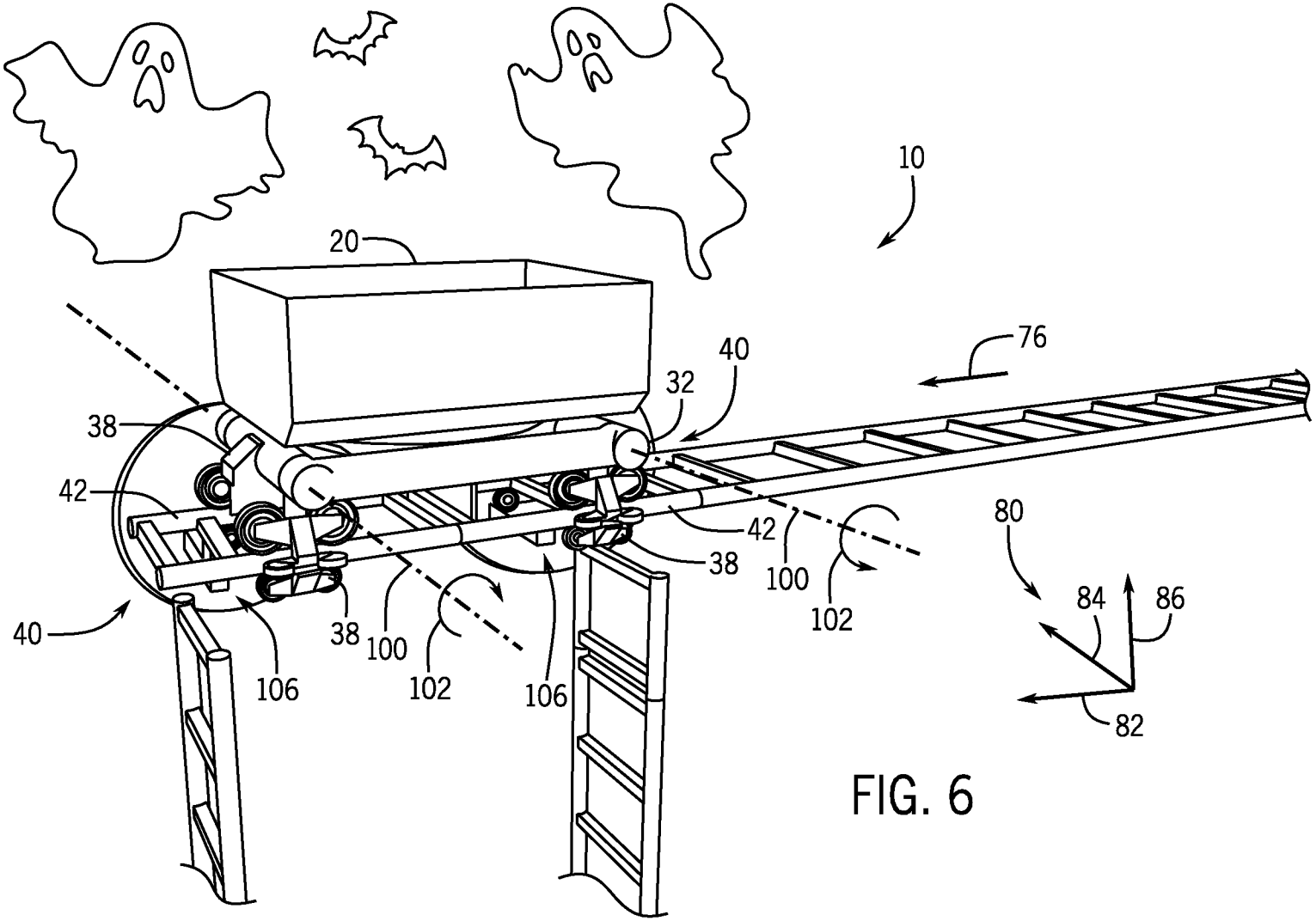
FIG. 6 is a schematic diagram of an embodiment of a ride vehicle operating in a ride system and traveling along a first direction of travel, in accordance with aspects of the present disclosure.

FIG. 6 is a schematic diagram of an embodiment of the ride vehicle 20 operating in the ride system 10 and traveling along the first direction of travel 76, in accordance with aspects of the present disclosure. The ride vehicle 20 may travel along the first direction of travel 76 and stop along the rotatable track members 42 at a target position in which the roller assemblies 38 and corresponding rotatable track members 42 each have a substantially similar axis of rotation. Each roller assembly 38 may be configured to rotate about a respective second axis 100 to enable rotation of each roller assembly 38 in a second direction 102. The rotatable track members 42 may be supported via a support assembly 106 configured to withstand the load of the ride vehicle 20. The support assembly 106 may support the rotatable track members 42, and when the roller assemblies 38 are engaged with the rotatable track members 42, a portion of the load of the ride vehicle 20 may thereby the transferred to the support assembly 106. The ride vehicle 20 may be held in place by a fork lift device. Alternatively or additionally, the ride vehicle 20 may be secured to pins positioned on the chassis 32 along the second axis 100. Alternatively or additionally, the ride vehicle 20 may be held in place with a holding brake attached to each rotatable track segment 42 which engages with the roller assemblies 38 on the ride vehicle 20.

Figure 7:
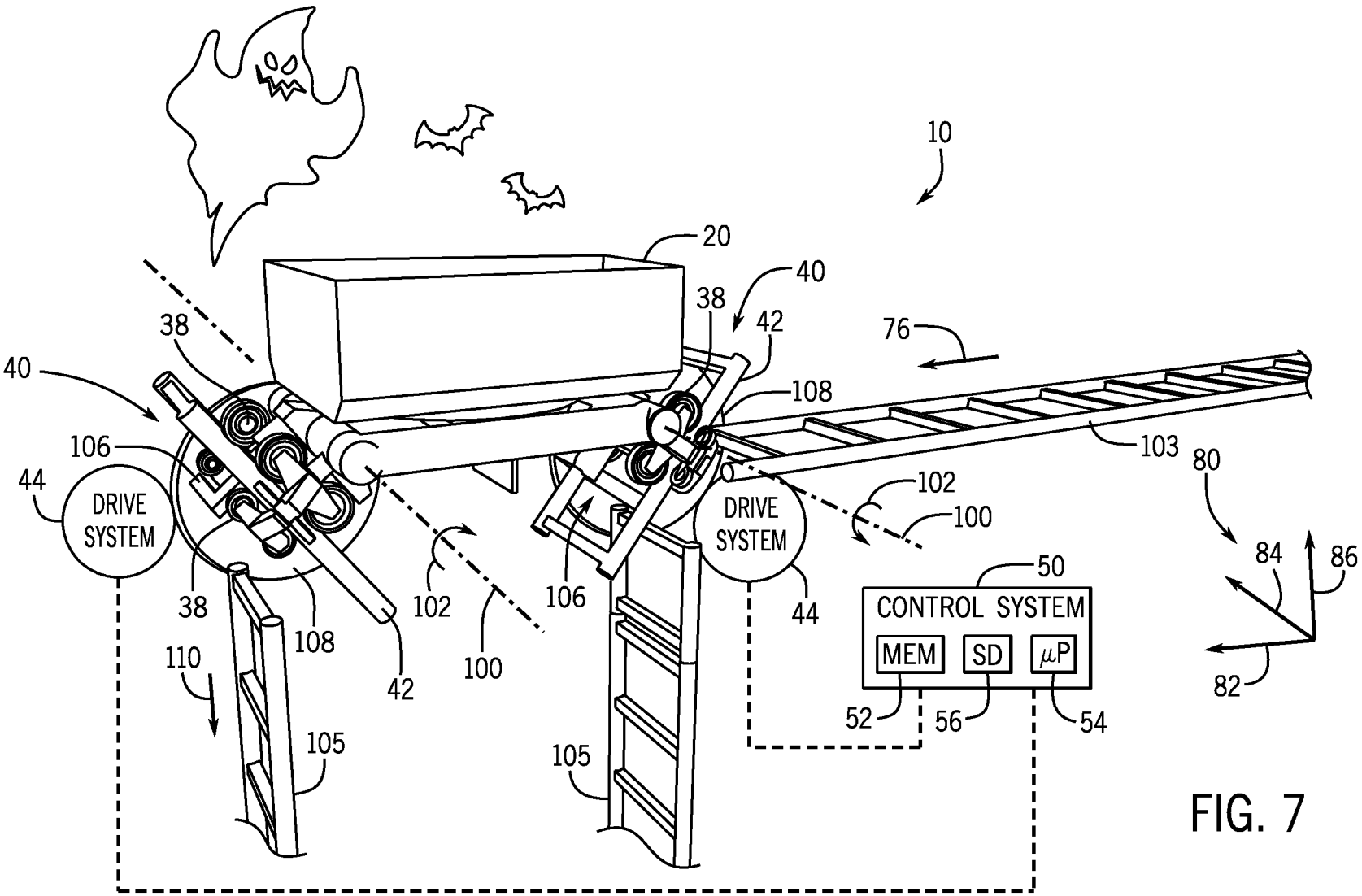
FIG. 7 is a schematic diagram of an embodiment of a rotating motion system actuating to enable a ride vehicle to modify the direction of travel from a first direction of travel to a third direction of travel, in accordance with aspects of the present disclosure.

FIG. 7 is a schematic diagram of an embodiment of the rotating motion system 40 actuating to enable modification of the direction of travel of the ride vehicle 20 from the first direction of travel 76 to a third direction of travel 110, in accordance with aspects of the present disclosure. After determining that the roller assemblies 38 are secured to respective rotatable track members 42 at the target position on the rotatable track members 42, the control system 50 may instruct the drive system 44 to drive one or more rotating disks 108 in rotation. Driving the rotating disks 108 in rotation results in rotation of the rotatable track members 42, which are coupled to the rotating disks 108, to change the direction of travel of the ride vehicle 20 from the first direction of travel 76 to the third direction of travel 110. More specifically, the rotatable track members 42 are individually actuated from alignment with tracks 103 aligned in the first direction of travel 76 and into alignment with tracks 105 oriented along the third direction of travel 110. It should be understood that, while the motion of the ride vehicle 20 is discussed above as being along a first, second, or third direction of travel, the motion of the ride vehicle 20 may be along any desired direction of travel.

Figure 8:
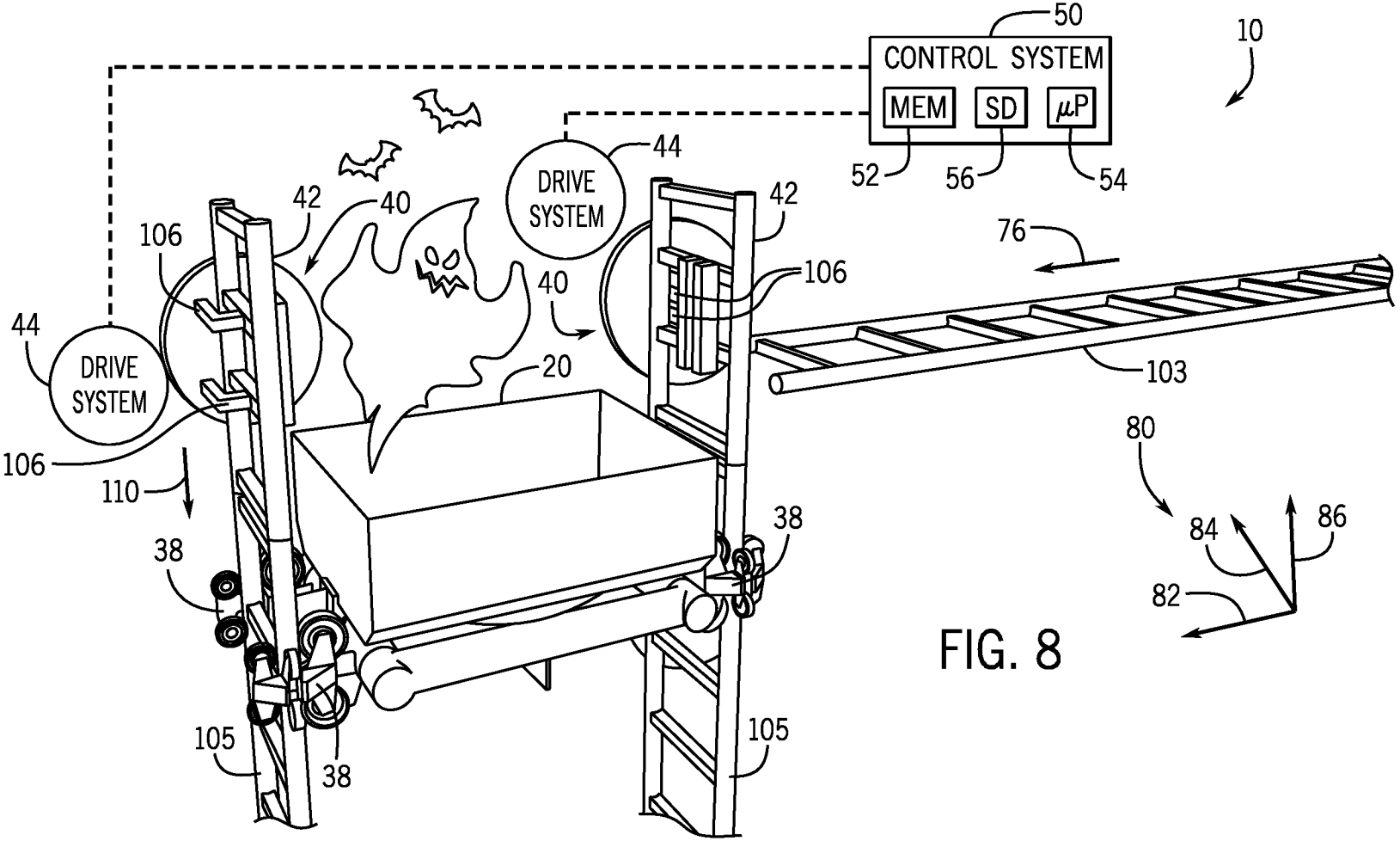
FIG. 8 is a schematic diagram of an embodiment of a ride vehicle operating in a ride system and traveling along a third direction of travel, in accordance with aspects of the present disclosure.

FIG. 8 is a schematic diagram of an embodiment of the ride vehicle 20 operating in the ride system 10 and traveling along the third direction of travel 110, in accordance with aspects of the present disclosure. The third direction of travel 110 may be oriented generally parallel to the gravity vector or may have a component along the gravity vector, such that motion of the ride vehicle 20 along the third direction of travel 110 may be gravity assisted. As discussed above, the direction of travel of the ride vehicle 20 may be changed by actuation of the rotatable track members 42, which may align with the tracks 105. It should be noted that, in FIG. 6, the rotatable track members 42 are aligned with one another (e.g., collinear) along the first direction of travel 76 to define a single track. However, after the actuation depicted in FIG. 7, the rotatable track members 42 are separately aligned with the tracks 105 of FIG. 8. In other words, each of the rotatable track members 42 is aligned with a separate set of tracks 105, each of which supports the ride vehicle 20 and guides the ride vehicle 20 along the third direction of travel 110. Furthermore, in one embodiment, a holding brake attached to each rotatable track segment 42 may hold the ride vehicle 20 in place by engaging the holding break to the roller assemblies 38 on the ride vehicle 20.

Figure 9:
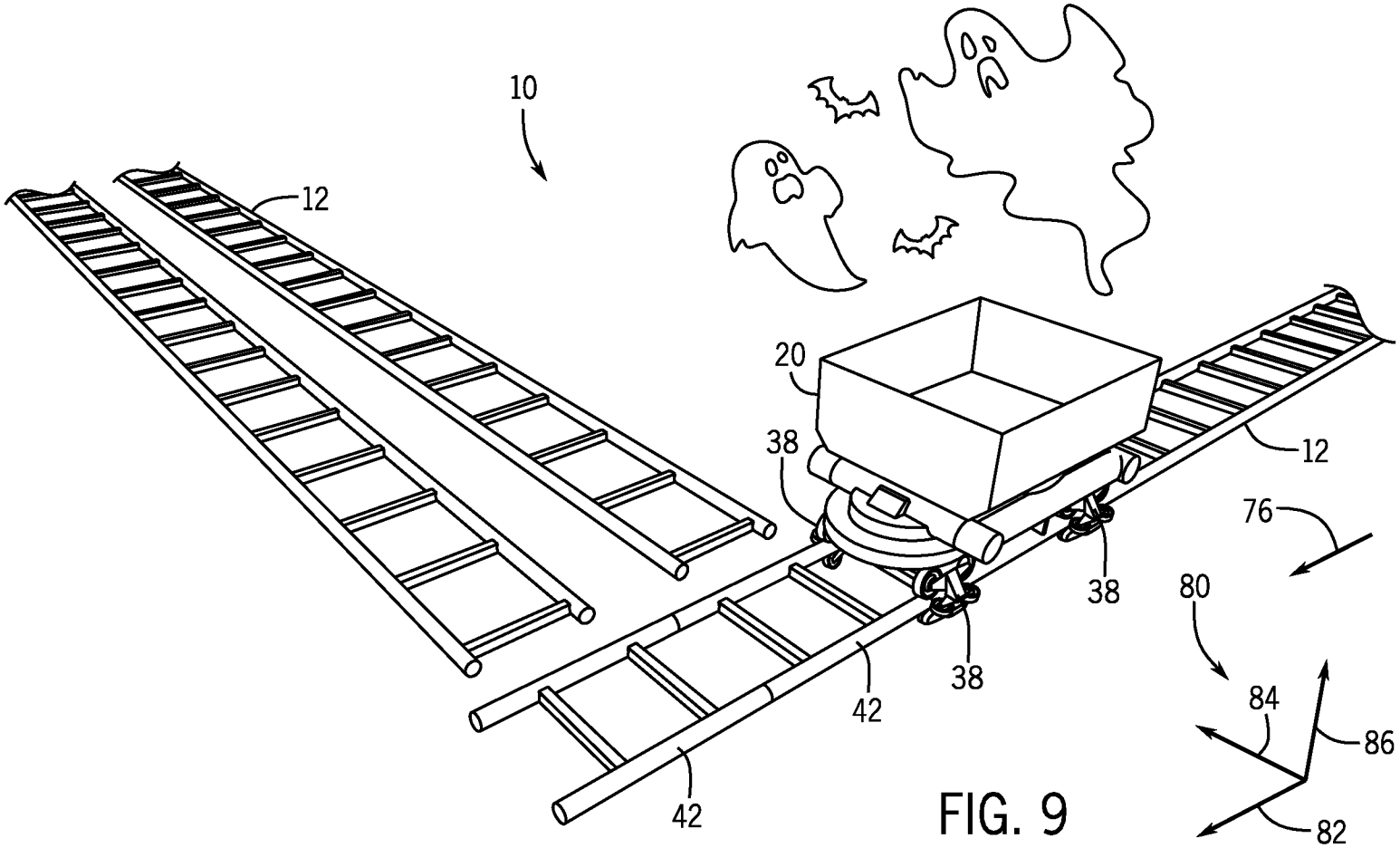
FIG. 9 is schematic diagram of an embodiment a ride vehicle operating in a ride system and traveling along a first direction of travel, in according with aspects of the present disclosure.
Figure 10:
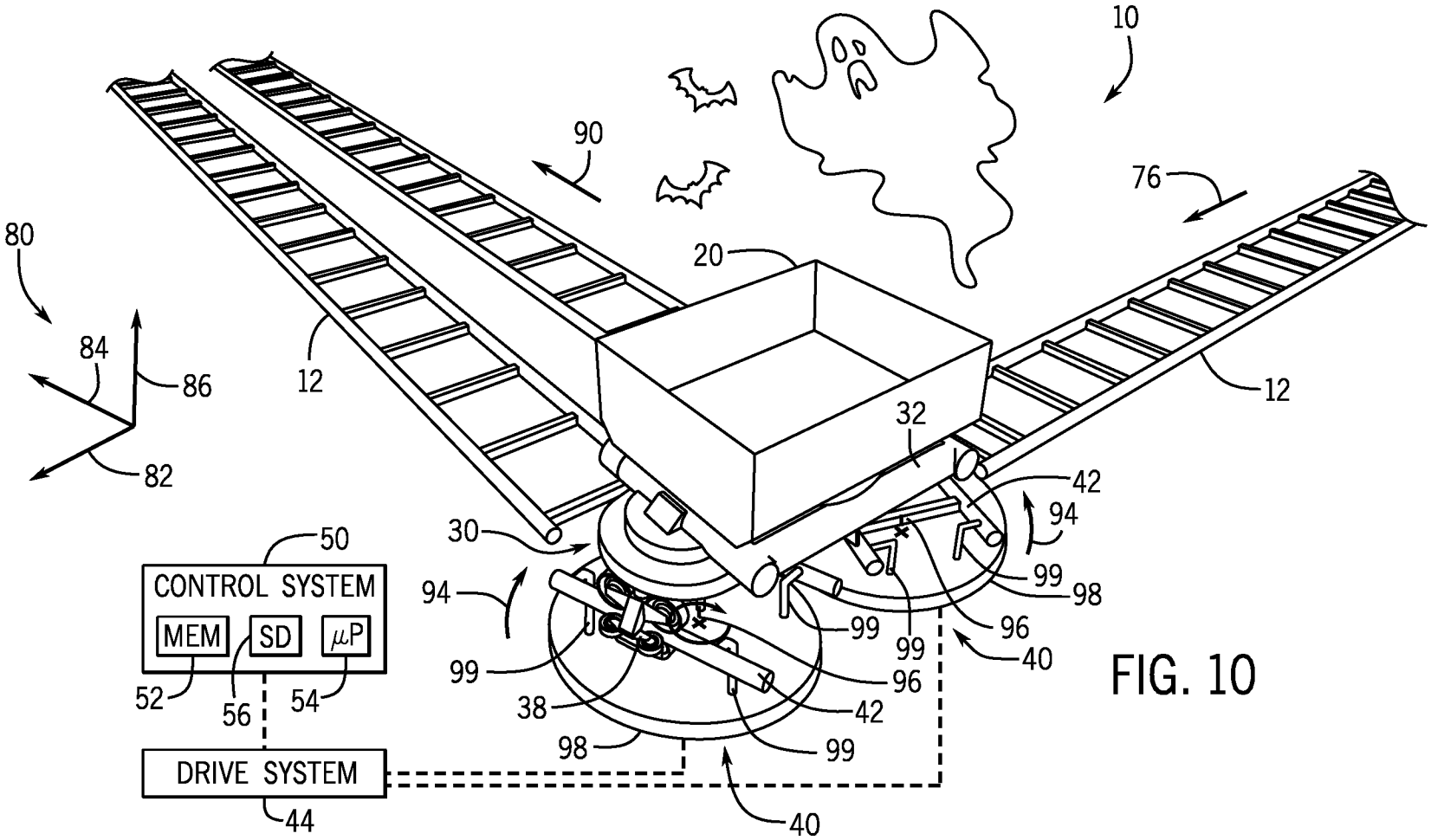
FIG. 10 is a schematic diagram of an embodiment of a rotating motion system actuating to enable a ride vehicle to modify the direction of travel from a first direction of travel to a second direction of travel, in accordance with aspects of the present disclosure.
Figure 11:
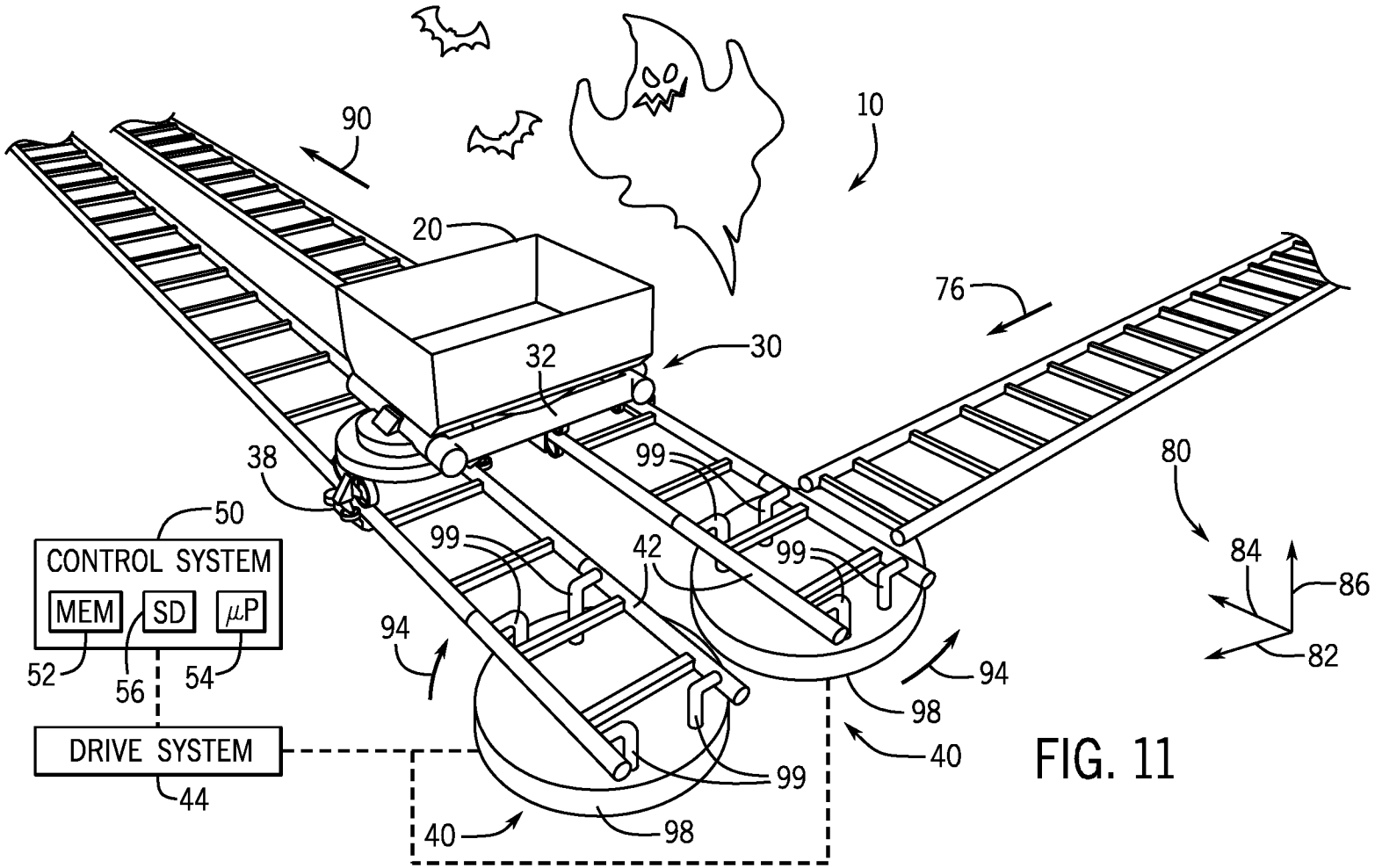
FIG. 11 is a schematic diagram of an embodiment of a ride vehicle operating in a ride system and traveling along a second direction of travel, in accordance with aspects of the present disclosure.

FIG. 9 is schematic diagram of an embodiment the ride vehicle 20 operating in the ride system 10 and traveling along the first direction of travel 76, in according with aspects of the present disclosure. In contrast to the embodiments of FIGS. 3-5, in which the rotating motion system 40 includes four rotatable track members 42, the embodiments of FIGS. 9-11 illustrate the rotating motion system 40 having two rotatable track members 42. In other words, each rotatable track member 42 shown in FIGS. 9-11 includes a track segment extending a width of the track or ride path 12, as compared to the rotatable track members 42 of FIGS. 3-5, which included a single bar or track element. Utilizing fewer rotatable track members 42 may reduce the number of components actuated to change a direction of travel of the ride vehicle 20, which may be easier to implement in practice. As may be appreciated, the roller assemblies 38 may be coupled to one or more rotating disks of the bogie system to facilitate aligning the roller assemblies 38 with respect to the platforms 98.

FIG. 10 is a schematic diagram of an embodiment of the rotating motion system 40 actuating to enable a change in the direction of travel of the ride vehicle 20 from the first direction of travel 76 to the second direction of travel 90, in accordance with aspects of the present disclosure. The bar members 99 coupled to the platforms 98 may be coupled to an interior portion or surface of the rotatable track members 42, such that the bar members 99 do not interfere with the roller assemblies 38 while the ride vehicle 20 travels along the ride path 12.

The control system 50 may instruct the drive system 44 to drive the rotating motion system 40 in rotation about the first axes 96 to change the direction of travel of the ride vehicle 20 from the first direction of travel 76 to the second direction of travel 90. For example, the first direction of travel 76 may be substantially perpendicular to the second direction of travel 90 along a plane of travel spanned by the longitudinal axis 82 and the lateral axis 84. In an embodiment, the rotating motion system 40 may include a plurality of platforms 98 driven in rotation via the drive system 44, based on control instructions from the control system 50. The platforms 98 may be rigidly coupled to respective rotatable track members 42 via the one or more bar members 99. While each platform 98 may include four bar members 99 coupled to a corresponding rotatable track member 42, it should be understood that any number of bar members 99 or platforms 98 may be employed to facilitate rotation of the rotatable track members 42.

FIG. 11 is a schematic diagram of an embodiment of the ride vehicle 20 operating in the ride system 10 and traveling along the second direction of travel 90, in accordance with aspects of the present disclosure. After the control system 50 instructs the drive system 44 to rotate, such as individually rotate, the rotatable track members 42, and after the positions of the rotatable track members 42 are verified as being along the second direction of travel 90 and in alignment with tracks of the second direction of travel 90, the control system 50 may drive motion of the ride vehicle 20 along the tracks of the second direction of travel 90.

Figure 12:
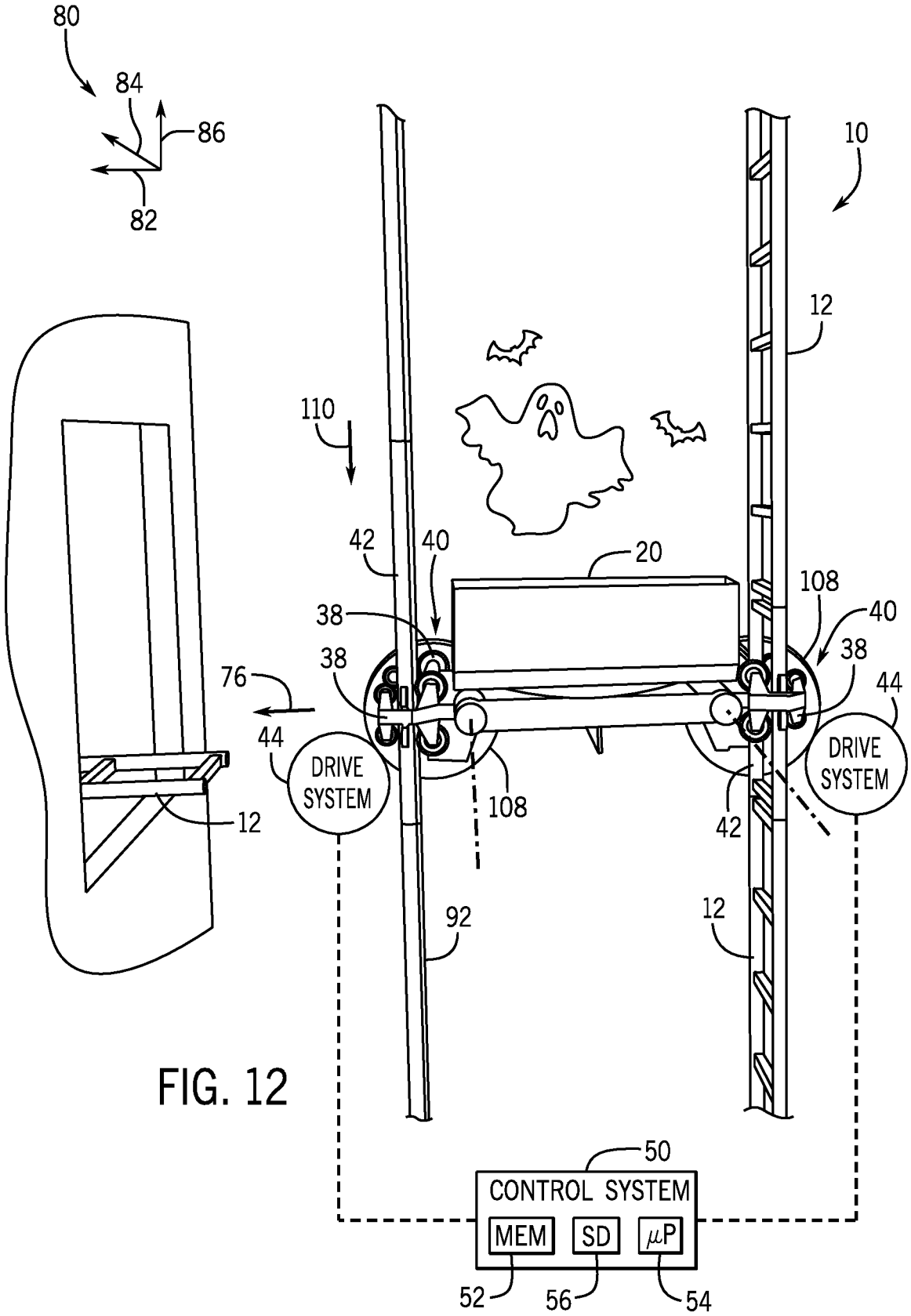
FIG. 12 is a schematic diagram of an embodiment of a ride vehicle operating in a ride system and traveling along a third direction of travel, in accordance with aspects of the present disclosure.

FIG. 12 is a schematic diagram of an embodiment of the ride vehicle 20 operating in the ride system 10 and traveling along the third direction of travel 110, in accordance with aspects of the present disclosure. A braking system may be engaged to decrease the speed of the ride vehicle 20 traveling along the third direction of travel 110. In an embodiment, the ride vehicle 20 may free fall (e.g., via gravity-assisted motion of the ride vehicle 20). The ride vehicle 20 may stop at target positions on the rotatable track members 42 via the braking system.

Figure 13:
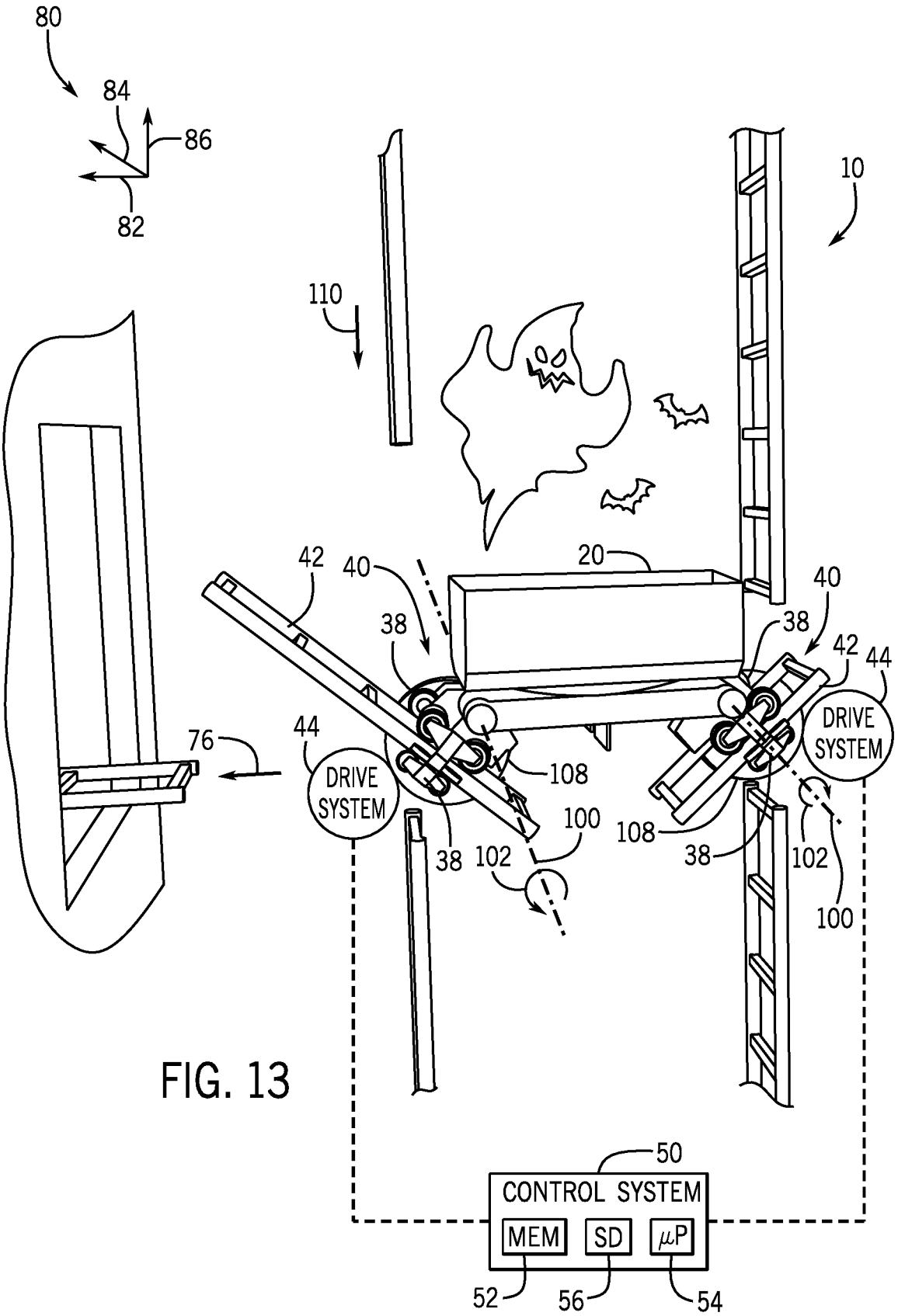
FIG. 13 is a schematic diagram of an embodiment of a rotating motion system actuating to enable a ride vehicle to modify direction of travel from a third direction of travel to a first direction of travel, in accordance with aspects of the present disclosure.
Figure 14:
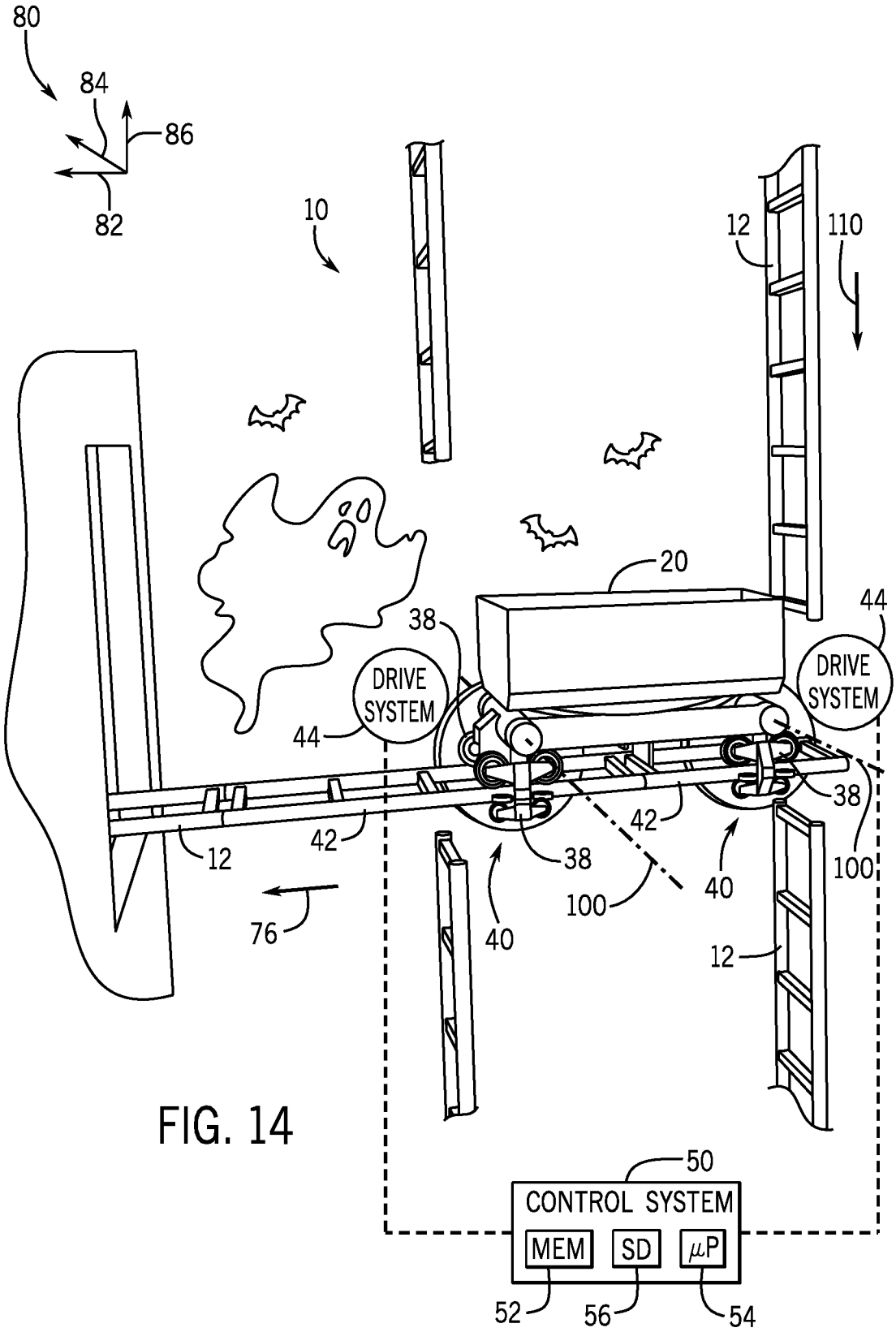
FIG. 14 is a schematic diagram of an embodiment of a ride vehicle operating in a ride system and traveling along a first direction of travel, in accordance with aspects of the present disclosure.

FIG. 13 is a schematic diagram of an embodiment of the rotating motion system 40 actuating to enable a change in direction of travel of the ride vehicle 20 from the third direction of travel 110 to the first direction of travel 76, in accordance with aspects of the present disclosure. After determining that each roller assembly 38 is secured to one of the rotatable track members 42 at the target position on the rotatable track members 42, the control system 50 may instruct the drive system 44 to drive rotation of the rotating disks 108 of the drive system 44. Driving rotation of the rotating disks 108 results in the respective rotation of the rotatable track members 42 about the second axes 100, thereby also causing the roller assemblies 38 to rotate in a similar direction about the second axes 100. In this manner, the rotatable track members 42 are rotated out of alignment with the tracks extending along the third direction of travel 110 and into alignment with the tracks extending along the first direction of travel 76. As shown, the rotatable track members 42 may differ in size. Indeed, the respective sizes of each rotatable track member 42 may be selected to enable each rotatable track member 42 to properly align with tracks extending in the first direction of travel 76, as well as tracks extending in the second direction of travel 90 (FIGS. 4, 5, 10, 11). For example, FIG. 14 is a schematic diagram of an embodiment of the ride vehicle 20 operating in the ride system 10 and traveling along the first direction of travel 76, in accordance with aspects of the present disclosure. As similarly described above, the control system 50 may individually actuate and rotate the rotatable track members 42 of different sizes to move the rotatable track members 42 from alignment with tracks extending in the third direction of travel 110 to alignment with tracks extending in the first direction of travel 76. Rotation of the rotatable track members 42 also causes rotation of the roller assemblies 38, which similarly rotate about the second axes 100 to align with the tracks extending in the first direction of travel 76.

Figure 15:
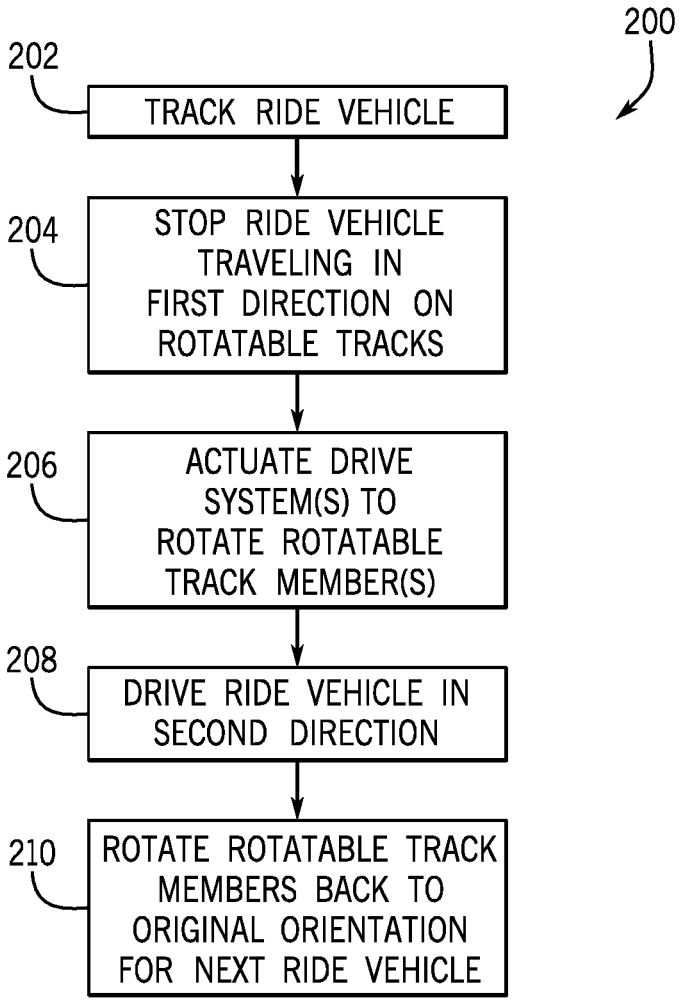
FIG. 15 is flow diagram of a process for modifying a direction of travel of a ride vehicle from a first direction of travel to a second direction of travel, in accordance with aspects of the present disclosure.

FIG. 15 is flow diagram 200 of a process for modifying a direction of travel of the ride vehicle 20 from the first direction of travel 76 to the second direction of travel 90, in accordance with aspects of the present disclosure. In an embodiment, the process of the flow diagram 200 may be implemented by a processor-based device, such as a controller of a control system 50. With the forgoing in mind, the control system 50 may track (process block 202) a location and/or movement of the ride vehicle 20. For example, the control system 50 may receive a position, velocity, or acceleration of the ride vehicle 20 via one or more sensor assemblies 46, as discussed in detail above.

The control system 50 may instruct the ride system 10 to stop (process block 204) the ride vehicle 20 traveling in the first direction of travel 76 at a target position on the rotatable track members 42. A stopping system, as discussed above, may facilitate deceleration of the ride vehicle 20 to stop (process block 204) along the rotatable track members 42 at the target position at which corresponding rotatable track members 42 and roller assemblies 38 may have a substantially similar axis of rotation.

In response to a determination that the roller assemblies 38 are at the target positions, the control system 50 may instruct the drive system 44 to actuate (process block 206) in accordance with control instructions to individually actuate the rotatable track members 42 to rotate from alignment with tracks extending along the first direction of travel 76 to alignment with tracks extending along the second direction of travel 90. As the roller assemblies 38 may be rotatably coupled to the chassis 32, rotation of the rotatable track members 42 may also drive rotation of the roller assemblies 38 relative to the chassis 32 to change a direction of travel of the ride vehicle 20. After the control system 50 receives confirmation (e.g., via the sensor assembly 46) that orientation of the rotatable track members 42 properly changed from alignment with tracks in the first direction of travel 76 to alignment with tracks in the second direction of travel 90, the control system 50 may drive (process block 208) the ride vehicle 20 along the tracks of the second direction of travel 90.

After the ride vehicle exits the rotatable track members 42, the control system 50 may instruct the drive system 44 to rotate (process block 210) the rotatable track members 42 back to the original position. Rotating (process block 210) the rotatable track members 42 back to the original position may include orienting the rotatable track members 42 to the position at which the rotatable track members 42 will receive the next ride vehicle 20, such that the rotatable track members further define the ride path 12 from which the next ride vehicle 20 will be received. After the ride vehicle exists the rotatable track members 42, the rotatable track members 42 may already be oriented at the position at which it will receive the next ride vehicle 20.

FIGS. 16 and 17 each depict a schematic diagram of an embodiment of ride vehicles 20 operating on respective ride paths 12, such that the motion of the ride vehicles 20 is facilitated via a rotating motion system 40, in accordance with aspects of the present disclosure. As illustrated, two ride paths 12 may share one or more portions of their respective ride paths 12 with one another. For example, two ride paths 12 may share a portion of the ride paths that includes the rotating motion system 40. The rotatable track members 42 may partially define one ride path when oriented in a first configuration and may partially define another ride path when oriented in a second configuration. In this manner, the control system 50 may actuate the rotating motion system 40 to change the motion of the ride vehicle from one ride path 12 to another ride path 12 by rotating the rotatable track members 42 as described above.

While only certain features of the disclosed embodiments have been illustrated and described herein, many modifications and changes will occur to those skilled in the art. It is, therefore, to be understood that the appended claims are intended to cover all such modifications and changes as fall within the true spirit of the disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A system, comprising:

a plurality of rotatable track members configured to guide travel of a vehicle, wherein each rotatable track member of the plurality of rotatable track members is configured to individually rotate between a first orientation along a first direction of vehicle travel and a second orientation along a second direction of vehicle travel, wherein the first direction of vehicle travel extends along a first plane, and the second direction of vehicle travel extends along a second plane different from the first plane.

2. The system of claim 1, wherein the first direction of vehicle travel is orthogonal to the second direction of vehicle travel.

3. The system of claim 1, comprising a driving assembly configured to rotate the plurality of rotatable track members between the first orientation and the second orientation.

4. The system of claim 3, wherein the driving assembly comprises a rotatable disk coupled to a first rotatable track member of the plurality of rotatable track members, and wherein the driving assembly is configured to rotate the rotatable disk to drive rotation of the first rotatable track member between the first orientation and the second orientation.

5. The system of claim 1, comprising the vehicle, wherein the vehicle comprises a plurality of roller assemblies configured to engage with the plurality of rotatable track members, and wherein each roller assembly of the plurality of roller assemblies is configured to rotate about one or more axes of rotation relative to a chassis of the vehicle.

6. The system of claim 5, wherein the plurality of roller assemblies comprises a first roller assembly configured to engage with a first rotatable track member of the plurality of rotatable track members, and wherein the first roller assembly comprises a first roller and a second roller disposed opposite the first roller relative to the first rotatable track member.

7. The system of claim 1, comprising the vehicle, wherein the vehicle comprises a brake assembly configured to stop motion of the vehicle on the plurality of rotatable track members, such that a first axis of rotation of each rotatable track member of the plurality of rotatable track members substantially aligns with a second axis of rotation of a corresponding roller assembly of a plurality of roller assemblies of the vehicle.

8. The system of claim 1, wherein at least one rotatable track member of the plurality of rotatable track members comprises a sensor configured to detect a position of the vehicle, a velocity of the vehicle, an acceleration of the vehicle, or a combination thereof.

9. The system of claim 8, comprising a controller communicatively coupled to the sensor and configured to control rotation of the plurality of rotatable track members based at least on the position, the velocity, the acceleration, or the combination thereof.

10. The system of claim 1, comprising:

a first set of tracks extending along the first direction of vehicle travel; and a second set of tracks extending along the second direction of vehicle travel, wherein each rotatable track member of the plurality of rotatable track members is configured to align with the first set of tracks in the first orientation and align with the second set of tracks in the second orientation to further define the first set of tracks and the second set of tracks, respectively.

11. The system of claim 1, wherein the first direction of vehicle travel is in a horizontal direction relative to the vehicle, and wherein the second direction of vehicle travel is in a vertical direction having a component along a gravity vector relative to the vehicle.

12. The system of claim 1, wherein a first rotatable track member of the plurality of rotatable track members is greater in length than a second rotatable track member of the plurality of rotatable track members.

13. The system of claim 1, wherein a first rotatable track member of the plurality of rotatable track members is configured to rotate from the first orientation to the second orientation in a first rotational direction, and a second rotatable track member of the plurality of rotatable track members is configured to rotate from the first orientation to the second orientation in a second rotational direction, opposite the first rotational direction.

14. The system of claim 1, wherein the plurality of rotatable track members comprises a first rotatable track member and a second rotatable track member, wherein the first rotatable track member and the second rotatable track member are disposed on a common side of the vehicle in the first orientation, and the first rotatable track member and the second rotatable track member are disposed on opposite sides of the vehicle in the second orientation.

15. A ride system, comprising:

a plurality of rotatable track members defining a first portion of a first ride path when oriented in a first orientation along a first direction and defining a second portion of a second ride path when oriented in a second orientation along a second direction, wherein a first rotatable track member of the plurality of rotatable track members is configured to rotate from the first orientation to the second orientation in a first rotational direction, and a second rotatable track member of the plurality of rotatable track members is configured to rotate from the first orientation to the second orientation in a second rotational direction opposite the first rotational direction;

a ride vehicle comprising one or more roller assemblies configured to facilitate ride vehicle motion along the first ride path and the second ride path; and a controller communicatively coupled to the ride vehicle and the plurality of rotatable track members, wherein the controller is configured to control the ride vehicle motion and rotation of the plurality of rotatable track members, wherein the controller comprises a processor and a memory device having stored instructions thereon, wherein the stored instructions are configured to be executed by the processor, and wherein the stored instructions are configured to cause the processor to:

send a first signal to a braking system to cause the braking system to decelerate the ride vehicle traveling along the first ride path in the first direction to a stopped position on the plurality of rotatable track members, such that each roller assembly of the one or more roller assemblies is configured to share a respective axis of rotation with a corresponding rotatable track member of the plurality of rotatable track members; and send a second signal to a drive system to cause the drive system to selectively rotate the plurality of rotatable track members from the first orientation along the first direction to the second orientation along the second direction, wherein selectively rotating the plurality of rotatable track members causes rotation of each roller assembly of the one or more roller assemblies about the respective axis of rotation.

16. The ride system of claim 15, wherein the first direction and the second direction are substantially perpendicular with respect to one another.

17. The ride system of claim 15, wherein the ride vehicle comprises a bogie system configured to generate motion of a cab of the ride vehicle in one of at least six degrees of freedom relative to a chassis of the ride vehicle.

18. The ride system of claim 17, wherein the ride vehicle comprises a turntable configured to rotate the cab relative to the chassis.

19. The ride system of claim 15, wherein the one or more roller assemblies are configured to rotate about a first axis of rotation, a second axis of rotation, or both, wherein the first axis of rotation is perpendicular to the second axis of rotation.

20. The ride system of claim 15, wherein the ride vehicle comprises a chassis and a cab configured to accommodate one or more ride passengers, wherein the cab is disposed above the chassis relative to a vertical axis when the plurality of rotatable track members is oriented in the first orientation and when the plurality of rotatable track members is oriented in the second orientation.

* * * * *